US011828102B2

(12) United States Patent
Brant

(10) Patent No.: US 11,828,102 B2
(45) Date of Patent: Nov. 28, 2023

(54) ADJUSTABLE PACKER APPARATUS

(71) Applicant: Craig Eric Brant, Papakura Auckland (NZ)

(72) Inventor: Craig Eric Brant, Papakura Auckland (NZ)

( * ) Notice: Subject to any disclaimer, the term of this patent is extended or adjusted under 35 U.S.C. 154(b) by 7 days.

(21) Appl. No.: 17/610,991

(22) PCT Filed: May 13, 2020

(86) PCT No.: PCT/NZ2020/050051

§ 371 (c)(1),
(2) Date: Nov. 12, 2021

(87) PCT Pub. No.: WO2020/231275

PCT Pub. Date: Nov. 19, 2020

(65) Prior Publication Data

US 2022/0220794 A1 Jul. 14, 2022

(30) Foreign Application Priority Data

May 14, 2019 (NZ) ..... 753527

(51) Int. Cl.
*E06B 1/60* (2006.01)
*E04F 21/00* (2006.01)

(52) U.S. Cl.
CPC ..... *E06B 1/603* (2013.01); *E04F 21/0015* (2013.01); *E06B 1/6076* (2013.01)

(58) Field of Classification Search
CPC ..... E04F 21/0015; E06B 1/603; E06B 1/6076
See application file for complete search history.

(56) References Cited

U.S. PATENT DOCUMENTS 1,718,813 A * 6/1929 Finley ..... E06B 1/08 49/505
2,169,985 A * 8/1939 Hiza ..... E06B 1/6076 52/217

(Continued)

FOREIGN PATENT DOCUMENTS

AU 199942464 A 3/2000

OTHER PUBLICATIONS

International Search Report for PCT/NZ2020/050051, Prepared by the Australian Patent Office, dated Jul. 20, 2020, 4 pages.

*Primary Examiner* — James M Ference
(74) *Attorney, Agent, or Firm* — BROOKS KUSHMAN PC; John E. Nemazi

(57) ABSTRACT

An adjustable packer apparatus for adjusting a clearance space between at least two support members. The adjustable packer apparatus having at least one first and one second planar member and adjustment means. The planar members are configured and spaced from each other and each include an one aperture there through whereby one planar member is movably attachable by the adjustment means through alignment of the at least one aperture of one planar member to the other planar member. The adjustment means includes at least one bolt attached to the second planar member. The first planar member has a threaded member protruding therefrom, wherein the bolt is threadingly engaged with the threaded member. The second planar member is attachable to one of the two support members which provides a stiffer or less flexible support than that provided by or for the first planar member. A method of installation is also disclosed.

16 Claims, 20 Drawing Sheets

(56) References Cited

U.S. PATENT DOCUMENTS 2,323,625 A * 7/1943 Seaman ..... E05D 7/0423 49/501
2,743,795 A * 5/1956 Taubman ..... A47K 3/34 52/843
3,156,331 A * 11/1964 Sklar ..... E06B 3/9885 49/505
3,222,833 A * 12/1965 Woodrum ..... E06B 3/9885 52/211
3,250,049 A * 5/1966 Sklar ..... E06B 1/6061 52/211
3,473,265 A * 10/1969 Marx ..... E06B 5/161 49/504
3,585,770 A * 6/1971 Maizler ..... E06B 1/6061 403/231
3,685,226 A * 8/1972 Richter ..... E06B 1/603 49/505
4,698,944 A * 10/1987 Wilkins, Jr. ..... E06B 1/603 49/504
4,873,804 A * 10/1989 Kukke ..... E06B 1/6076 411/116
9,194,170 B2 * 11/2015 Eis ..... E06B 1/6076
9,273,510 B2 * 3/2016 Pardoe ..... E06B 1/347
2001/0023557 A1 * 9/2001 Graham ..... E06B 1/6069 52/656.1
2003/0046885 A1 * 3/2003 Tavivian ..... E06B 1/6076 52/204.55
2005/0081473 A1 * 4/2005 MacDonald ..... E06B 1/6076 52/633
2008/0075556 A1 * 3/2008 Smith ..... F16B 5/0233 411/379
2010/0201138 A1 * 8/2010 Sauder ..... E05B 15/0245 292/340
2011/0179730 A1 * 7/2011 Kolovich ..... E06B 1/6046 52/204.2
2022/0220794 A1 * 7/2022 Brant ..... E06B 1/603

* cited by examiner

ADJUSTABLE PACKER APPARATUS

CROSS-REFERENCE TO RELATED APPLICATION

This application is the U.S. national phase of PCT Application No. PCT/NZ2020/050051 filed on May 13, 2020, which claims priority to NZ Patent Application No. 753527 filed on May 14, 2019, the disclosures of which are incorporated in their entirety by reference herein.

The present invention relates to an adjustable packer apparatus for adjusting the position at least of one member of the apparatus with respect to another member of the apparatus and to a method of installation. The invention is directed particularly but not solely towards an adjustable packer apparatus for adjust a clearance space between members being a support member such as a door jamb frame or window jamb frame construction from another member being a support member such as a wall having an opening to be lined by the jamb frame.

BACKGROUND OF INVENTION

Typically packers have been used to adjustably move one support member with respect to another support such as for door/window frames or jambs adjacent a wall frame or for mounting doors or windows, within a suitable opening in a wall. The door/window frame or jamb is usually spaced by a small gap or clearance to the wall frame of the wall to allow for adjustment there between which is then covered by suitable architraves etc.

Existing packers are usually selected from whatever comes to hand at a work site which are varied in size and shape and so are used as is, where is. However if adjustment is needed to the door or window frame or jamb, then one attempts to use multiple packers in a back to back assembly or the packers have to be reworked and reinstalled. Yet other problems occur when finding that the packers at hand are too big or too small thereby requiring fiddly wood working to make them fit in the small confined gap between the jamb and the wall frame.

These packers can also easily fall out of place in the gap or they may need trimming or shaping to remove any protruding portion beyond the wall thickness. Other problems with existing packers are that they can also deteriorate when in place making them something extra requiring maintenance including retro replacing or not been able to be readily later adjusted or re-adjusted. Furthermore existing packers are often not able to be reused as they can easily get damaged during removal or during reconstruction of the wall.

Using existing make-shift packers with the extra time required to locate, adjust and trim, also significantly add to construction times and costs. Later adjustment of a door frame or jamb is not easy or possible after the door frame is installed in an opening in a wall, nor is it usually possible without at least the removal of the door, and architraves.

Other problems during the adjustment of existing make shift packers which comprise planar packer members, can include inadvertent unwanted rotation of one of the planar members with respect to the other planar member requiring regular re-adjustment of the other planar member. Furthermore yet other problems can occur during manufacture of packers whereby moulding of small planar members can be tedious especially when removing separate planar member from a mould for packaging or when handling them from a stored package to location on site to be used to cause suitable adjustment.

All references, including any patents or patent applications cited or mentioned in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein; this reference does not constitute an admission that any of these documents form part of the common general knowledge in the art, in Australia, New Zealand or in any other country.

OBJECT OF THE INVENTION

It is an object of the invention to provide an improved adjustable packer apparatus and method that ameliorates some of the disadvantages and limitations of the known art or at least provide the public with a useful choice.

SUMMARY OF INVENTION

In a first aspect, the invention resides in an adjustable packer apparatus for adjustably adjusting a clearance space 2 between the members of the apparatus and when in use between at least two support members 4, 12, wherein the adjustable packer apparatus comprises at least one first and one second planar member 30 and 32 and adjustment means 34, wherein the planar members 30, 32 are configured and spaced from each other and each include a body with at least one aperture 49, there through whereby one planar member 30 is adjustably movably attachable by the adjustment means 34 through alignment of the at least one aperture 49, of one planar member 30 to the other planar member 32, and adjustment means 34 includes at least one bolt having a head 64 at one end, adjusting end 84 at other end and outer thread body 62 movably attached to and protruding from the rear or second planar member 30 and the first or front planar member 30 has a threaded member 66, 104 protruding therefrom, wherein the bolt is threadingly engaged with the threaded member 66, 104, wherein the at least second planar member 32 is attachable to one of the two support members 4, 12 which provides a stiffer or less flexible support than that provided by or for the first planar member 30, whereby in use the first and second planar members 30, 32 can be called front and rear planar members, whereby adjusting the adjustment means 34 causes one planar member 30 to move in a direction perpendicular to its planar plane (as attachable to one support member 4) with respect to the other planar member 32 which is attachable to the other support member 12, to reduce or increase the clearance 2 there between the planar members 30, 32, whereby during adjustment ie rotation initiated from/about adjusting end 84 either clockwise or anti-clockwise, of the bolt 62 which threadingly moves and travels through the threaded member 66, 104 while a head end 64 of the bolt 62 is held positionally there about but is rotatable there about, rear planar member 32, optional backing plate 150 and wall 12, is immovable or not readily deformable in comparison to the front planar member 30 and jamb member 4 or base member 76, to cause the front planar member 30 with its threaded member 66, 104 with the jamb member or base member 76 to move accordingly to either narrow or widen the clearance gap 2 between the front and rear planar members 30, 32 and between the jamb member 4 or base member 76 and the wall 12 or optional backing plate 150.

Preferably when in use one planar member 30 is a first or front planar member attachable to a rear face 16 of the one support member 4 and the second or rear planar member 32 is attachable to the another support member 12 wherein one support member 12 is stiffer or less flexible than the other support member, wherein the said one support member 4 is a jamb member 4 or base member 76 and the other support member 12 is a back plate member 150 or part of a wall 12 which is stiffer than the first planar member 30 and jamb member 4 whereby movement by adjustment means 34 of a portion of the jamb member 4 ie base member 76 causes the clearance space 2 to be reduced by pulling the front planar member 30 and jamb member 4 towards the wall 12 or the clearance space 2 is enlarged by pushing front planar member 30 and jamb member 4 move away from the wall 12, whereby narrowing the clearance gap 2 includes anti-clockwise turning/rotating of the bolt 62 towards the front planar wall 30/jamb member 6 or base member 76 (away from the wall 12/rear planar wall 32) because the wall 12 and rear planar member 32 is relatively immovable as compared to the jamb member 4 or base member 76 and the head 64 is freely rotatable within the rear planar member 32 but not longitudinally movable, this bolt turning causes the head 64 of the bolt 62 to pull against the screw fasteners of the rear planar member 32 while threading through the nut/sleeve 66, 104 of front planar member 30, which draw or pulls in the jamb member 4 or base member 76/front planar member 30 towards the wall 12 or rear planar member 32 while the bolt threadingly travels towards and through the front planar member 30, causing an end of the bolt to be protruding within nut 66/sleeve 104 access aperture 82 and expanding the clearance gap 2 includes clockwise turning/rotating of the bolt towards the rear planar member 32/wall (away from the front planar member 30/jamb member 4 or base member 76) but because the wall 12 is relatively immovable as compared to the jamb member 4 or base member 76, and the head 64 is freely rotatable within the rear planar member 32 but not longitudinally movable, this bolt turning causes leveraging or pushing of the bolt head 64 against the wall 12/rear planar member 32, while the bolt is threadingly travels away from and through nut/sleeve 66, 104 of the front planar member 30 in the opposite direction, to push or draw the front planar member 30/jamb member 4 or base member 76 outwardly away from the rear planar member 32/wall 12, causing an end of the bolt to not protrude from nut 66/sleeve 104 within access aperture 82.

Preferably the direction of adjustment is oriented in a plane parallel with the length of the adjustment means 34 (or at right angles to the plane of planar members 30, 32) whereby the threading rotational movement of the adjustment means 34 about a fixed length position with a head 64, held in the rear planar member 32 at one end, and threadably within the fastening nut 66 or sleeve 101 as attached to the front planar member 30 at the other end, causing the front planar member 30 and jamb member 4 to be pushed in towards the or pulled out at least a portion of the front planar member 30 (and jamb member 4) with respect to the other planar member 32 and wall 12 with the rear planar member 32 thereby altering the dimension of the clearance 2 there between the planar members 30, 32 (and the support members eg jamb member 4 and wall 12).

Preferable the one support member 4 is at least a part of a door or window jamb member 4 and the other support member 12 is part of a wall or wall frame 12, and the jamb member 4 is shaped and constructed to be movable with respect to the wall frame 12, whereby first or front planar member 30 has apertures 48 for fastening the first or front planar member to rear face 76 of the jamb member 4, wherein the jamb member 4 comprising when assembled or formed body including a jamb base member 76 and stop member 78 wherein the base member 76 includes a row of access apertures 80 which are positioned to be co-extensive or aligned with the apertures 48, of the rear planar member 32, to allow insertion of at least one fastener 61 to be inserted there though apertures 80 to apertures 48 to fasten the rear planar member 32 to the wall 12 and to allow access to adjustment means 34 from rear planar member 32 protruding through central access aperture 89 to allow suitable adjustment of the front planar member 30 attachable to jamb member 4 with respect to the wall 12.

Preferably the wall 12 includes a structure having a thickness and an opening 10 wherein the opening includes a reveal or wall frame 12 facing the opening 10 and the jamb base member 76 is sized and configured to face that wall frame face 18 by having a width similar to the thickness of the wall 12 with its wall covering 24 and be spaced there from by the clearance space 2 wherein the planar members 30, 32 have an area (being the planar area oriented at right angles to the thickness and width of the planar member) which such areas are selected to not protrude beyond the wall thickness and jamb thickness and be less in dimension that the width of the wall frame of the wall 12.

Preferably, the bolt of adjustment means 34 comprises a threaded elongate member 62, and the threaded members 66, 104 are first and second nut fasteners 66, 73, the threaded elongate member 62 includes a head 64 at one end and adjusting end 84 (eg slot for wedge screw driver) at the other end wherein one fixed nut fastener 66 or threaded sleeve 104 is located within and beyond the central aperture 49 attached to the front planar member 30.

Preferably, the planar members 30, 32 which include front planar member 30 and rear planar member 32, wherein the planar members 30, 32 include a body with a row of fixing apertures 48 for sliding receipt of suitable fasteners 61 there through wherein the apertures for each planar member 30, 32 include at least outer apertures 48, and middle or central aperture 49, between the two outer apertures 48—forming rows of apertures 43 and 43'. Wherein middle apertures 49 are for the adjustment means 34 to be affixed thereto and the outer apertures 48 are for providing fixing of the planar members 30,32 to each of the support members 4, 12

Preferably, the rear planar member 32 is shaped having a central recessed portion 50 to house a head member 64 of the fastener 32 which allows the head member 64 to rotate but not move from its position in the recessed portion 50 when the threaded elongate body 62 is rotating during adjustment.

Alternatively, the rear planar member 32 is shaped having a central cavity portion 102 to house or capture a head 64 of the fastener which allows the head 64 to rotate but not move from its position within the cavity portion 102 when the elongate threaded body 62 of the fastener is rotating during adjustment.

Preferably, at least one of the front and rear planar members 30, 32 are shaped as a rectangular shape having a length and thickness wherein the thickness is less than the width, and the length is longer than the width, and the length of the front planar member 30 is less than the width or thickness of jamb member 4 and the width of the rear planar member 32 is less than the width or thickness of the wall.

Preferable each planar member has a length, width and thickness wherein the front planar member 30 is 70 mm long, 30 mm wide and 3.5 mm thick and the rear planar member 32 is 80 mm long, 30 mm wide and 5 mm thick wherein the rear planar member 32 is thicker than the thickness of front planar member 30, which is adapted to hold the head 64 of the fastener 62, 101 therein.

Preferably wherein, the planar member 30, 32 is trimmed after installation to fit within the thickness 47 of the wall 12 without wall coverings 24 or width of the jamb base member 76 and not protrude therefrom, at least one of the apertures 48 of the planar members 30, 32 is provided with at least one slotted aperture 128 to allow for adjustment of the jamb base member 76 and apparatus 1 in a vertical plane with respect to the wall 12 after installation of the jamb base member 76 with attached front planar member 30 but before attachment of the rear planar member 32 to the wall 12, wherein the slotted apertures 128 are provided in the apertures 48 of the rear planar member 32 whereas horizontal or sideways adjustment of at least the jamb base member 76 of jamb member 4 and apparatus 1 is provided by use of the method whereby one fastener 61 is located but not attached to the rear planar member 32 to the wall to allow rotation of the frame member by pivoting there about.

Preferably the planar members 30, 32 are spaced from each other and adjustably fastened together by the adjustment means 34 whereby nut fastener 66 or sleeve 104 is located on one side ie a front of front planar outer surface or first surface 36 of the planar member 30, and nut fastener 73 is located on the other side ie inner planar side or second surface 38 of the front or first planar member 30, being located within aperture 49 and access aperture 82 and the bolt 62 of the adjustment means 34 has it head located on an outer surface or first surface 36 of rear planar member 32.

Preferably a joining means 100 joins or connects the front or first planar member 30 to the rear or second planar member 32, wherein the joining means 100 is formed of an elongate planar member being of a material and shape more flexible than the planar members 30, 32 which functions to keep the relative positions and orientation between planar members 30, 32 to be substantially constant during manufacture, installation and/or adjustment.

Preferably, adjustment of the apparatus 1 includes initiation by rotating the adjusting end 84 of the threaded elongate member 62 of adjustment means 34 which has a distal end captured inside of rear planar member 32, which such rotation in either direction causes the threaded elongate member 62, 108 to rotate to move longitudinally and cause the front planar member 30 to move laterally to cause an attachable jamb base member 76 to move commensurate with the said rotation to cause the clearance space 2 to increase or decrease in dimension.

Preferably, the apertures 48, 49, 128, of one of the planar members 30 or 32 are oriented at right angles to the row of apertures 48, 49, 128, of the other planar member 32 or 30 wherein the row of apertures 48, 49, 128, for the front planar member 30 are oriented horizontally. Preferably apertures 48, 49, 128 located on inner face or second surface 38 of both planar members 30, 32 can be countersunk 142 to accommodate the head of fasteners 61, Preferably, the planar members 30, 32 are fabricated from a metal or plastics material and abutment members 140 (eg a stud, screw, pin or nail) is/are inserted, driven or screwed beside the length dimension of the rear planar member 32 to prevent rotation of the rear planar member 32 when the front planar member 30, fastening means or adjustment means 34 are being inserted, fitted or adjusted into place on and with respect to the jamb 4.

Preferably the front planar member 30 having a longitudinal major axis is orientated at an angle with regard to a longitudinal major axis of the rear planar member 32 wherein the front planar member 30 having a longitudinal major axis is orientated at right angles to a longitudinal major axis of the rear planar member 32.

Preferably the thickness 114, 124 of the planar members 30, 32, the depth of the clearance 2 between support members 4 and 12 and length of the adjustment means 34 are selected to allow for suitable adjustment there between the support members 4, 12 and the thickness 114, 124 of the planar members 30, 32 of any of the embodiments cannot be thicker than the gap or clearance 2 (28) between the support members 4 and 12.

Preferably the length of the threaded elongate member 62 or threaded bolt 101 needs to be longer than the combined dimensions of the clearance 2 between jamb member 4 and wall 12, the thickness 114, 124 of the planar members 30, 32, the thickness of the jamb base member 76, and length 129 of the fixing nut 66, threaded sleeve 104, to allow suitable adjustment of the clearance 2 between the support members 4, 12.

Preferably after installation of the apparatus in the clearance space 2 between the jamb base member 76 and wall 12, before fixing the rear or second planar member 32 to the face 18 of wall 12, suitable adjustment of the position of the jamb base member 76 can be made vertically using the apertures 48 which are slotted apertures 128 or horizontally by locating but not fixing one fastener 61 in the top or bottom slotted apertures 128 which allows at least the jamb base member 76 to be moved or rotated horizontally about the one screw 61 before final fastening in place of the rear or second planar member 32 to the face 18 of the wall 12.

In a second aspect, the invention resides in a method of installation of the invention of an adjustable packer apparatus for adjustably adjusting a clearance space 2 between members of the apparatus and when in use between at least two support members 4, 12 of at least one side of wall opening eg hinged side, wherein the adjustable packer apparatus comprises at least one first and one second planar member 30 and 32 and adjustment means 34, wherein the planar members 30, 32 are configured and spaced from each other and each include a body with at least one aperture 49, there through whereby one planar member 30 is adjustably movably attachable by the adjustment means 34 through alignment of the at least one aperture 49, of one planar member 30 to the other planar member 32, and adjustment means 34 includes at least one threaded member eg bolt having a head 64 at one end, adjusting end 84 at other end and outer thread body 62 movably attached to and protruding from the rear or second planar member 30 and the first or front planar member 30 has a threaded member 66, 104 protruding therefrom, wherein the bolt is threadingly engaged with the threaded member 66, 104, wherein the at least second planar member 32 is attachable to one of the two support members 4, 12 which provides a stiffer or less flexible support than that provided by or for the first planar member 30, whereby in use the first and second planar members 30, 32 can be called front and rear planar members, whereby adjusting the adjustment means 34 causes one planar member 30 to move in a direction perpendicular to its planar plane (as attachable to one support member 4) with respect to the other planar member 32 which is attachable to the other support member 12, to reduce or increase the clearance 2 there between the planar members 30, 32, whereby during adjustment ie rotation initiated from/about adjusting end 84 either clockwise or anti-clockwise, of the bolt 62 which threadingly moves and travels through the threaded member 66, 104 while a head end 64 of the bolt 62 is held positionally there about but is rotatable there about, rear planar member 32, optional backing plate 150 and wall 12, is immovable or not readily deformable in comparison to the front planar member 30 and jamb member 4 which includes at least a jamb base member 76, to cause the front planar member 30 with its threaded member 66,104 with at least the jamb base member 76 to move accordingly to either narrow or widen the clearance gap 2 between the front and rear planar members 30, 32 and between the jamb member 4 or jamb base member 76 and the wall 12 or optional backing plate 150, wherein the method includes the following steps of:

1. Assemble or provide at least one adjustable packer apparatus 1 including planar members 30, 32 (eg first or front planar member 30 and second or rear planar member 32) and adjustment means 34;
2. Provide at least one support member 4 ie at least a jamb base member 76 for positioning adjacent another support member 6 to provide when fitted to an opening 10 in a wall 12 a clearance space 2 there between (eg support member 4 includes a jamb member including a jamb member 4 including at least a jamb base member 76 and optional a stop member 78);
3. By locating the position of stop member 78, drill vertical oriented spaced holes outer access hole or apertures 80 and middle access apertures 82 to provide co-linear access to the holes/apertures 48 of the rear planar member 32 when being attached to the stud of the wall frame 12;
4. Install adjustable packer apparatus 1 to rear face 16 of jamb base member 76, by fixing fastening fasteners 61 through horizontal oriented apertures 48 of front planar member 30 to back face 16 of one of the support members 4 eg jamb base member 76 of jamb member 4;
5. Position jamb base member 76 with attached front planar member(s) 30 to rear face 16, into opening 10 of wall 12 to create clearance space 2 there between base member 76 and support member 12;
6. Affix rest of adjustable packer apparatus 1 by fastening, fasteners 61 through vertically oriented access apertures 80 of rear planar member 32 to end face 18 of the other support member (eg stud 26 of wall 12);
7. Operate adjustable packer apparatus 1 to adjust the size of the clearance space 10 by initiating adjustment means 34 via adjusting end 84 of threaded elongate member 62 through middle aperture 82 and through nut fastener 66 or threaded sleeve 104, to cause one of the support members 4 and one of the planar members 30 to move with respect to the other support member 12 and other planar member 32;
8. Optionally affix stop member 78 in place on jamb base member 76 of jamb member 4 to cover access apertures 80, 82.

Preferably after installation of the planar members 30, 32 on the jamb base member 76 and wall 12, the planar members 30. 32 are trimmed to remove any protruding portion(s) from the width of the jamb base member 76 and at least the thickness 47 of the wall 12

Preferably after installation of the apparatus in the clearance space 2 between the jamb base member 76 and wall 12 after step 5 at step; 6, before fixing the rear or second planar member 32 to the face 18 of wall 12, suitable adjustment of the position of the jamb base member 76 can be made vertically using the apertures 48 which are slotted apertures 128 or horizontally by fixing one fastener 61 in the top or bottom slotted apertures 128 which allows at least the jamb base member 76 to be moved or rotated horizontally about the one screw 61.

In a third aspect, the invention resides in a method of use of an adjustable packer apparatus for adjustably adjusting a clearance space 2 between the members of the apparatus and when in use between at least two support members 4, 12, wherein the adjustable packer apparatus comprises at least one first and one second planar member 30 and 32 and adjustment means 34, wherein the planar members 30, 32 are configured and spaced from each other and each include a body with at least one aperture 49, there through whereby one planar member 30 is adjustably movably attachable by the adjustment means 34 through alignment of the at least one aperture 49, of one planar member 30 to the other planar member 32, and adjustment means 34 includes at least one bolt having a head 64 at one end, adjusting end 84 at other end and outer thread body 62 movably attached to and protruding from the rear or second planar member 30 and the first or front planar member 30 has a threaded member 66, 104 protruding therefrom, wherein the bolt is threadingly engaged with the threaded member 66, 104, wherein the at least second planar member 32 is attachable to one of the two support members 4, 12 which provides a stiffer or less flexible support than that provided by or for the first planar member 30, whereby in use the first and second planar members 30, 32 can be called front and rear planar members, whereby adjusting the adjustment means 34 causes one planar member 30 to move in a direction perpendicular to its planar plane (as attachable to one support member 4) with respect to the other planar member 32 which is attachable to the other support member 12, to reduce or increase the clearance 2 there between the planar members 30, 32, whereby during adjustment ie rotation initiated from/about adjusting end 84 either clockwise or anti-clockwise, of the bolt 62 which threadingly moves and travels through the threaded member 66, 104 while a head end 64 of the bolt 62 is held positionally there about but is rotatable there about, rear planar member 32, optional backing plate 150 and wall 12, is immovable or not readily deformable in comparison to the front planar member 30 and jamb member 4 or base member 76, to cause the front planar member 30 with its threaded member 66,104 with the jamb member or base member 76 to move accordingly to either narrow or widen the clearance gap 2 between the front and rear planar members 30, 32 and between the jamb member 4 or base member 76 and the wall 12 or optional backing plate 150, wherein the method includes the following steps of:

1. Provide at least one adjustable packer apparatus 1 for adjusting one support member 4 with respect to another support member 12 wherein each apparatus includes planar member 30, 32 and adjustment means 34, wherein the planar members 30, 32 have middle apertures 49 between outer apertures 48 and the support members includes a wall with an opening for a door and a jamb member 4 including door jamb base members 76, on top and sides of a door jamb frame whereby the sides of the jamb frame include hinged and non hinged sides with at least one apparatus 1 per hinge and non hinged sides as required, 2. Each base member 76 of jamb member 4 is provided with suitably spaced three vertically aligned access apertures or holes 80 (top and bottom), 82 (middle) to be located wherever the adjustable packer apparatus 1 are to be located eg at the top, middle and bottom of a door jamb base member 76 between the base member 76 and wall 12 whereby one aperture ie middle aperture 82 between two outer apertures 80 (top hole & bottom hole) is for the adjustment means 34 ie threaded elongate member 62 and the outer two apertures 48 are for accessing the fixing of rear or second planar member 32 of the adjustable packer apparatus 1 to the end face 18 of wall 12;
3. Attach each adjustable packer apparatus 1 to a rear of jamb base member 76 of jamb member 4 by attaching fasteners 61 through a first or front planar member 30 to a rear face 16 of the base member 76 of jamb member 4 ie attach each adjustable packer apparatus 1 to suitable positions on the rear of jamb base member 76 ie eg top, middle and bottom of rear face 16 of jamb base member 76 of at least the non hinge side, (and optionally to the hinged side) whereby the two outer horizontally oriented apertures 48 of the front planar member 30 are screwed there through to at least the non hinge side portion (eg face 16) of the jamb frame 4 at the pre-hung door factory and the attachment means 34 is located within the middle access aperture 82 of the jamb base member 76 to be accessible there from and within; then the pre-hung door 8 would be assembled as normal to the jamb member as a frame, then be ready for delivery to site. And similarly for the hinged side jamb portion and optionally the top portion could also have adjustable packer apparatus 1 fitted also.
4. Once on site containing the other support member 12 having opening 10, the hinged side of the jamb frame 4 is attached to the end stud 26 of the wall frame 12 utilizing several apparatus 1 which are positioned and fixed away from the hinges whereby the jamb member is adjusted vertically to be plumb and horizontally to fit within the walls thickness as required;
5. At the top of the jamb frame 4 this is fixed next, by checking the door 8 had a correct gap or clearance space 2 across the top and wedging up with apparatus 1 if needed;
6. Then for non-hinged side, align a top adjustable packer apparatus 1 (ie top side portion of the jamb base member 76) vertically with the stud 26 by then winding one adjustable packer apparatus 1 (ie near the top of base jamb 76) until one end 68 of threaded elongate member 62 hits/abuts the stud 26 (ie face 18) and fix the (rear) planar member 32 of the adjustable packer apparatus 1 with a screw 61 using a top hole 80 through the jamb base member 76 for access to top hole 48 of the rear planar member 32 which allows horizontal adjustment of the jamb member pivoting about the top screw;
7. For the non hinged side, next align for the bottom adjustable packer apparatus 1, the bottom side portion of the jamb base member 76 vertically with stud 26 by then fixing the top of this adjustable packer apparatus 1 with screw 61 using a top hole 80 through the jamb base member 76 for access to a top hole 48 of the rear planar member 32 which allows horizontal adjustment of the jamb member pivoting about the top screw;
8. Next fix the top adjustable packer apparatus 1 at the centre of this adjustable packer apparatus 1 with a screw 61 using a top hole 80 through the jamb base member 76 for access to the top hole 48 of the rear planar member 32;
9. Finish fixing the top adjustable packer apparatus 1 minor movement can be made sideways or horizontal just by tapping the jamb member 4 or base member 76 across, then fixing the bottom of this adjustable packer apparatus 1 with a screw 61 using the bottom hole 80 though the jamb base member 76 for access to the bottom hole 48 of the rear planar member 32;
10. Fixing the middle adjustable packer apparatus 1 minor movement can be made sideways just be tapping the jamb base member 76 across then fixing the bottom of the middle adjustable packer apparatus 1 with a screw 61 using the top hole 80 through the jamb for access to the top hole 48 of the rear planar member 32 and the bottom hole 80 through the jamb for access to the bottom hole 48 of the rear planar member 32;
11. Finish fixing the bottom adjustable packer apparatus 1 minor movements can be made sideways or horizontal just by tapping the jamb base member 76 across then fixing the bottom of the bottom adjustable packer apparatus 1 with a screw 61 using the bottom hole 80 though the jamb base member 76 for access to the bottom hole 48 of the rear planar member 32;
12. Now all adjustable packer apparatus 1 (at the top of the door and top, middle and bottom for non hinged side) are secured, then close the door 8 checking the gap or clearance space 2 between the edge of the door 8 and the jamb base member 76, adjust the top middle and bottom adjustable packer apparatus 1 using the adjusting screw 62, 101 to get the correct gap and tighten the (cocking) nut fastener 66 if fitted to hold secure;
13. Door gaps 2 can be adjusted at any time before the architraves (not shown) are installed to cover these gaps 2;
14. Door stop member 78 can now be installed around the door 8 covering the fixing and adjustment holes 80, 82.

Preferably after installation of the planar members 30, 32 on the jamb base member 76 and wall 12, the planar members 30, 32 are trimmed to remove any protruding portion(s) from the width of the jamb base member 76 and the thickness 47 of the wall 12.

In a fourth aspect, the invention resides in a door jamb assembly which includes at least one adjustable packer apparatus for adjustably packing a clearance space 2 between two support members 4, 12, and support members 4, 12 wherein the assembly includes the adjustable packer apparatus which comprises at least one first and one second planar member 30 and 32 and adjustment means 34, wherein the planar members 30, 32 are configured and spaced from each other and each include a body with at least one aperture 49, there through whereby one planar member 30 is adjustably movably attachable by the adjustment means 34 through alignment of the at least one aperture 49, of one planar member 30 to the other planar member 32, and adjustment means 34 includes at least one bolt having a head 64 at one end, adjusting end 84 at other end and outer thread body 62 movably attached to and protruding from the rear or second planar member 30 and the first or front planar member 30 has a threaded member 66, 104 protruding therefrom, wherein the bolt is threadingly engaged with the threaded member 66, 104, wherein the at least second planar member 32 is attachable to one of the two support members 4, 12 which provides a stiffer or less flexible support than that provided by or for the first planar member 30, whereby in use the first and second planar members 30, 32 can be called front and rear planar members, whereby adjusting the adjustment means 34 causes one planar member 30 to move in a direction perpendicular to its planar plane (as attachable to one support member 4) with respect to the other planar member 32 which is attachable to the other support member 12, to reduce or increase the clearance 2 there between the planar members 30, 32, whereby during adjustment ie rotation initiated from/about adjusting end 84 either clockwise or anti-clockwise, of the bolt 62 which threadingly moves and travels through the threaded member 66, 104 while a head end 64 of the bolt 62 is held positionally there about but is rotatable there about, rear planar member 32, optional backing plate 150 and wall 12, is immovable or not readily deformable in comparison to the front planar member 30 and jamb member 4 or base member 76, to cause the front planar member 30 with its threaded member 66,104 with the jamb member or base member 76 to move accordingly to either narrow or widen the clearance gap 2 between the front and rear planar members 30, 32 and between the jamb member 4 or base member 76 and the wall 12 or optional backing plate 150.

BRIEF DESCRIPTION

The invention will now be described, by way of example only, by reference to the accompanying drawings:

First Embodiment of the Invention

FIG. 1 is a front perspective view of the adjustable packer apparatus in accordance with a first preferred embodiment of the invention.

FIG. 2 is a rear perspective view of the adjustable packer apparatus

FIG. 3 is front view of the adjustable packer apparatus in use in a doorway opening FIG. 4 is a front view of the adjustable packer apparatus FIG. 5 is a rear view of the adjustable packer apparatus FIG. 6 is a cross sectional side view of the adjustable packer apparatus as assembled FIG. 7 is a cross sectional side view of the adjustable packer apparatus as assembled in a doorway FIG. 8 is a cross sectional top view of the adjustable packer apparatus as assembled FIG. 9 is a cross sectional top view of the adjustable packer apparatus assembled in a doorway opening FIG. 10 is a front perspective view of the planar member attached to the rear of the jamb FIG. 11 is a rear perspective view of the planar member of FIG. 10

FIG. 12 is a front perspective view of the other planar member attachable to the end face of the wall FIG. 13 is a rear is a perspective view of the other planar member of FIG. 12

FIG. 14 is a side view of an alternative orientation of the planar members ie the planar member of the rear of the jamb being oriented vertically with the other planar member being oriented horizontally.

FIG. 15 is a top view of an alternative orientation of the planar members ie the planar member of the rear of the jamb being oriented vertically with the other planar member being oriented horizontally.

Second Embodiment of the Invention

FIG. 16 is an upper perspective view

FIG. 17 is a lower perspective view

FIG. 18 is a front view

FIG. 19 is a top view

FIG. 20 is a side view

FIG. 21 is a front side perspective view of the fastening means

FIG. 22 is a rear side perspective view

FIG. 23 is a front end view

FIG. 24 is a first side view

FIG. 25 is a rear end view

FIG. 26 is a second side view

FIG. 27 is a plan view of the assembly after manufacture and before repositioning for use FIG. 28 is an end view of one of the plan members FIG. 29 is a side view FIG. 30 is a cross sectional top view of lugs being use to steady the position of the rear planar member FIG. 31 is a vertical cross section of the apparatus in place affixed to a gap between a jamb member and wall FIG. 32 is a horizontal cross section of the apparatus in place affixed to a gap between a jamb member and wall This invention may also broadly be said to consist in the parts, elements and features referred to or indicated in the specification of the application, individually or collectively, and any or all combinations of any two or more of the parts, elements or features, and where specific integers are mentioned herein which have known equivalents such equivalents are deemed to be incorporated herein as if individually set forth.

DESCRIPTION OF DRAWINGS

The following description will describe the invention in relation to preferred embodiments of the invention, namely an adjustable packer assembly 1 and method. The invention is in no way limited to these preferred embodiments as they are purely to exemplify the invention only and that possible variations and modifications would be readily apparent without departing from the scope of the invention.

Figure 1:
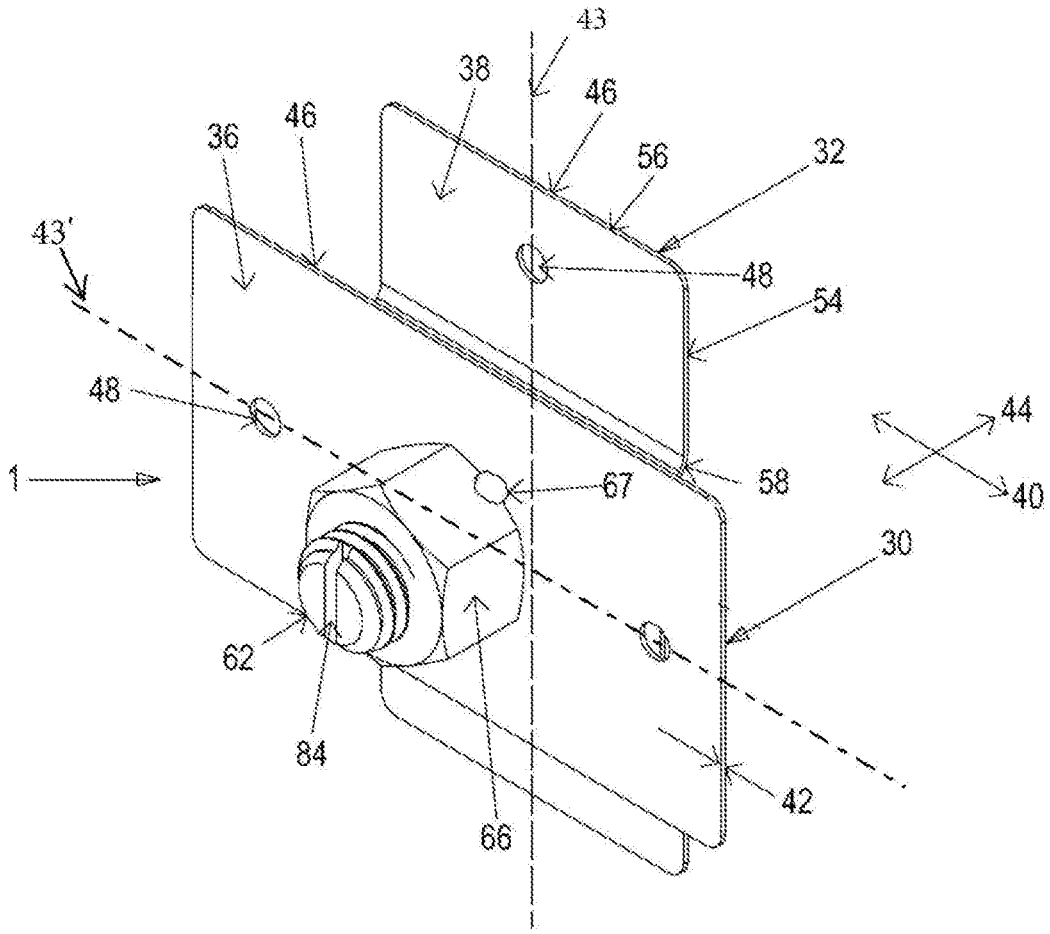
FIGS. 1-15 and 16-32 shows at least one adjustable packer apparatus 1 in at least two embodiments, for use in gap or clearance space or gap 2 between two support members eg a jamb frame member 4 (eg door or window jamb for a wing member such as a door or window) and an end edge or reveal 6 of an opening 10 in a wall or wall frame 12, to adjust the amount of the clearance space 2 between the components of the adjustable packer apparatus and between the support members. A wing member 8 eg a door is shown in FIG. 3 which is mounted on jamb base member 76 in opening 10. The adjustment by the apparatus 1 of the present invention, of support members 4, 12 with respect to each other support member is more possible or easier when one of support members is less stiff or more flexible than the other. In general the door jamb member 4 or support member 4 can be fixed to the opening with screws or nails in combination with the apparatus of the current invention.
Figure 2:
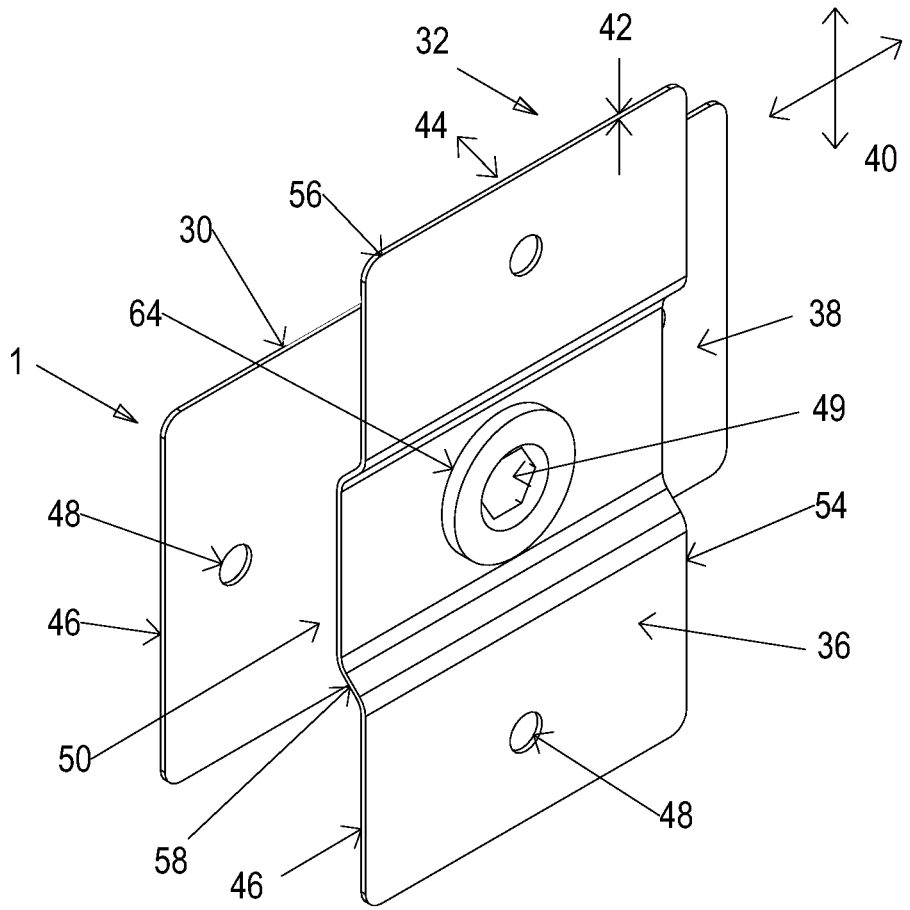
Figure 3:
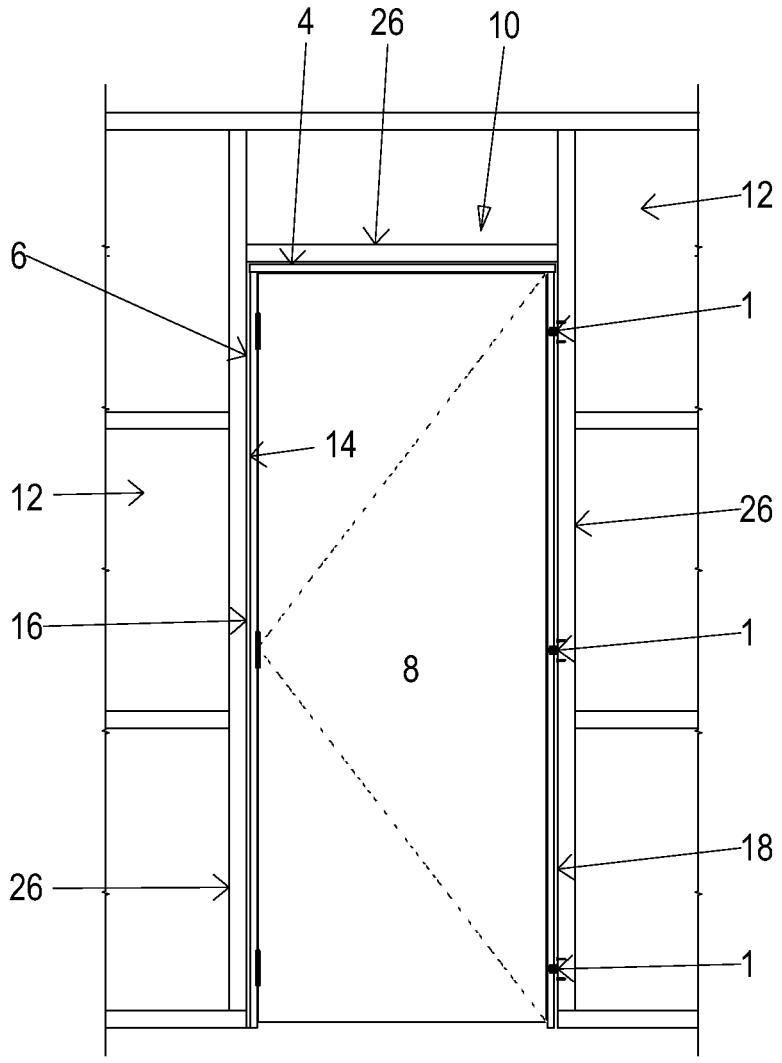
Figure 4:
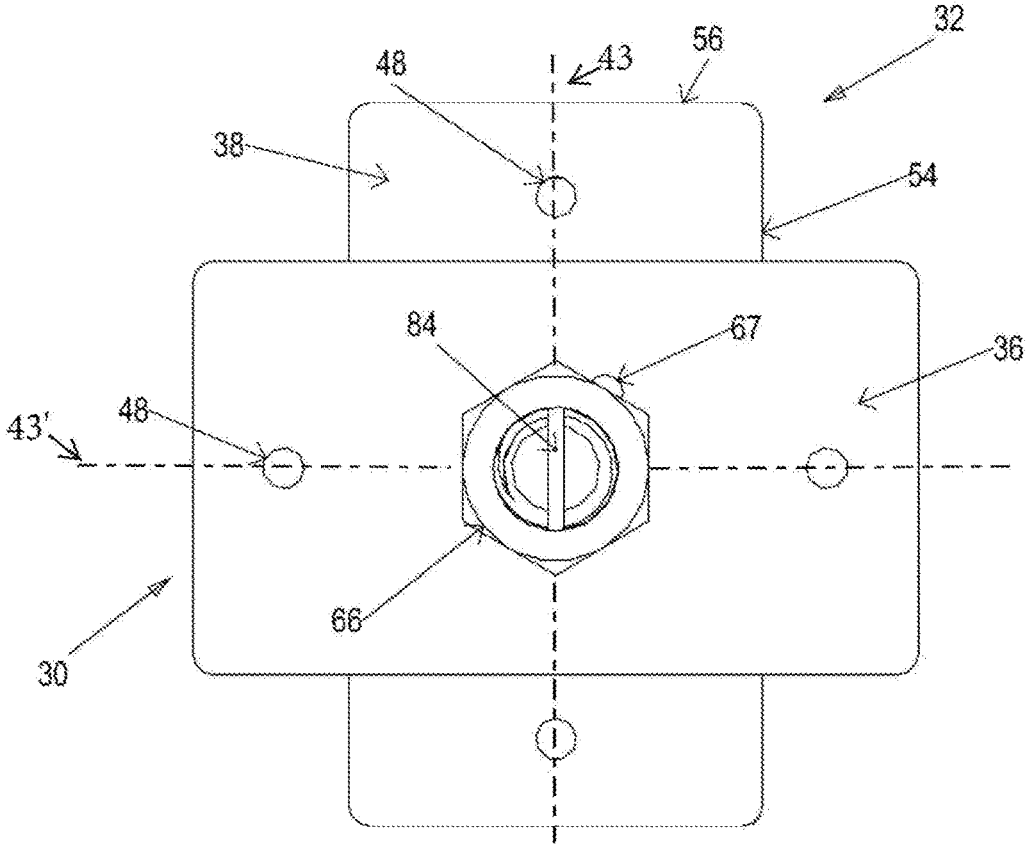
Figure 5:
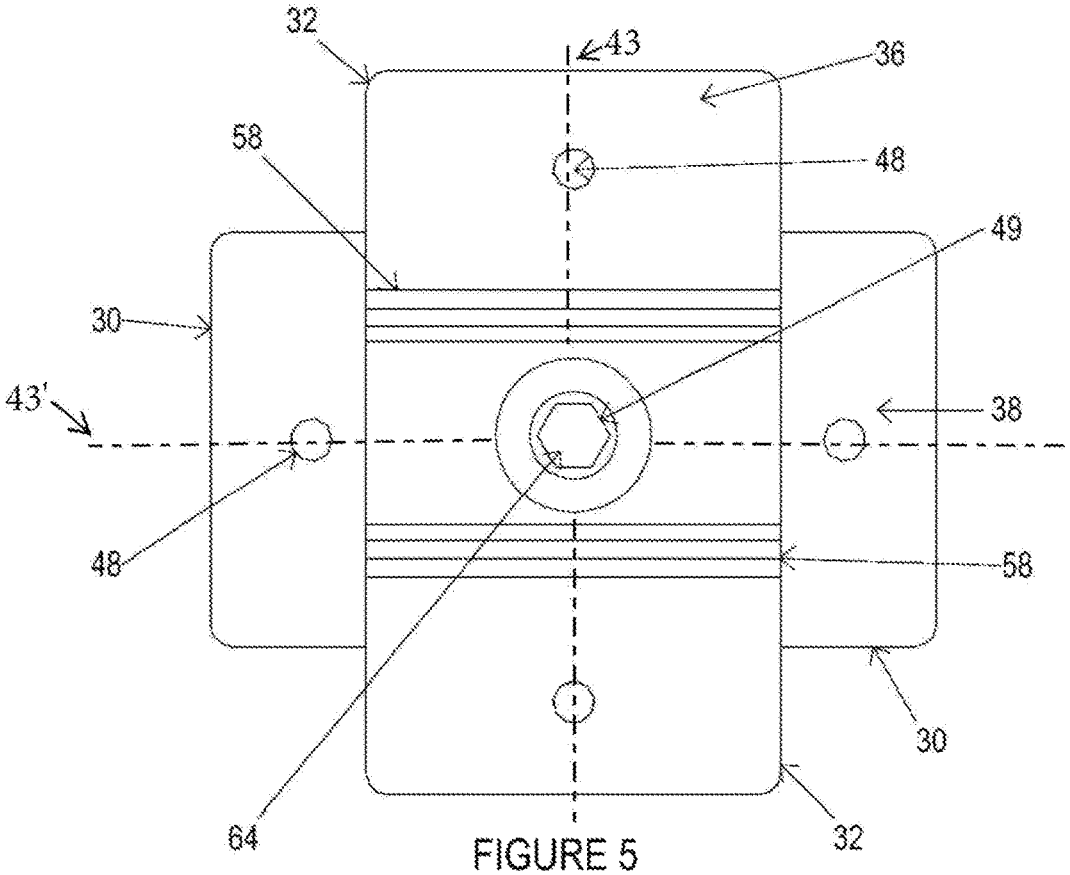

The door jamb member 4 includes a frame including a base member 76 with has an inner jamb face 14 facing the door and outer jamb face 16 facing the space 2 and the reveal 6 of the wall, the opening 10 has an opening end face 18 facing the space 2 and outer jamb face 16 and the wall 12 has an outer wall face 20 and inner wall face 22 comprising in this example outer facings 24 supported by an internal frame having stud 26 at end to provide end face 18. The outer jamb face 16 faces the clearance 2 and outer wall face 18. As further described, the door frame can formed as a square U shape comprising connected components of at least a top, hinged side and non hinged side, with each component including a base member 76 and stop member 78. The inner jamb face 14 and outer jamb face 16 relate to the base member 76 of the jamb member 4 as a whole and define a base member thickness dimension 15 there between.

One support member 4 is at least part of a door or window jamb or door/window jamb frame and the other support member 12 is at least part of a wall or wall frame wherein the jamb member 4 which is shaped and dimensioned to face and be spatially from (ie by clearance space 2) but affixed to the opening 10, is also designed to or able to be movable in at least a portion thereof with respect to the wall frame 12. The wall 12 includes a structure having a thickness 47 between facings 24 and the opening 10 wherein the opening 10 includes the reveal or wall frame facing the opening 10 and the jamb base member 76 is sized and configured to face that wall frame face of the opening 10 by having a width similar to the thickness of the wall and be spaced there from by the clearance space 2. Typically each opening 10 and door or window jamb frame 4 having clearance space 2 can include several connected vertical gaps and horizontal gaps (though any angled gap is possible) and so several adjustment apparatus 1 or at least one, will be needed to better adjust each clearance space 2. For example, there can be three spaced adjustment apparatus in the vertical clearance gap and two spaced in the horizontal gap. It depends on what works best for adjusting or moving at least a portion of the door or window jamb 4 with respect to the reveal 6, opening 10 or wall 12.

The thickness of the jamb base member 76 is measured at right angles to the width and relates to the thickness of the jamb bae member 76 of the jamb member 4. The planar members 30, 32 have an area (being the planar area oriented at right angles to the thickness and width of the planar members 30, 32) which such areas are selected in this example to not protrude beyond the wall thickness and jamb thickness and be less in dimension that the width of the wall frame of the wall (but could protrude in other examples to then be trimmed). The planar members 30, 32 can be plate like members being thin and planar whereby there is a first or front planar member 30 and a second or rear planar member 32.

Clearance space 2 has a cross sectional thickness dimension 28 defined as being that distance between the opening end face 18 of reveal 6 of the wall or wall frame 12 of the opening 10 to an outer face 16 of the adjacent jamb frame member 4 with a width dimension commensurate with but not greater than a thickness 47 of the wall or jamb between an inner face of the wall coverings 24 or not greater than the width beyond the wall coverings 24.

Each adjustable packer 1 when in use is configured and designed to cause at least a portion of one support member (eg the door jamb base member 76) to adjustably move with respect to another support member which is fixed or not movable ie a wall 12 when the adjustable packer apparatus is in use is located within an opening between the door jamb base member 76 in an opening 10 in a wall 12, whereby adjustment of the adjustment means 34 causes one planar member 30 of the adjustment apparatus which is attached to a rear of the jamb base member 76 to move with respect to a fixed wall surrounding the opening in the wall 12.

The adjustable packer apparatus 1 includes at least a, first or front planar member 30, at least, a second or rear planar member 32 and adjustment means 34. Each planar member 30 and 32 comprises a body shaped having a first planar outer surface or first surface 36, a second planar surface or second surface 38 defining a first plane 40, spaced by a thickness dimension 42 in a second plane 44 oriented at right angles to the first plane 40. The first planar surface or first surface 36 and inner planar surface or second surface 38 are bordered by an edge 46. Each planar member 30, 32 in this example is rectangular shaped having a longitudinal major axis 45 and having dimensions that are less than the width of jamb member or base member 76 or thickness 47 of the frame of the wall 12. First planar surfaces or first surface 36 face outwardly of the clearance space 2 whereas second surfaces 38 face inwardly of the clearance space 2 and face each other.

The width of jamb member 4 or base member 76 is typically greater that the thickness 47 of the wall which includes facing or covering 24 but practically it is simpler to have the width of the planar members 30, 32 to a maximum thickness 47 of the wall so as to not protrude into the covering 24 or having any fasteners 61 too close to the edge to either not be easily fastened or not have adequate depth of fastening cover. In use or when assembled, the first planar surfaces or first surface 36 of front planar member 30 and rear planar member 32 face the inner surface 16, 18 of the jamb base member 76 and the reveal 6. Second planar surfaces or second surface 38 of front planar member 30 and rear planar member 32 face each other and the clearance space 2.

Each planar member 30 and 32 have at least three spaced fixing apertures whereby these fixing apertures include outer apertures 48 and a middle aperture 49 which are oriented in a row rows of apertures 43 and 43' (not needed to be strictly in a row but be able to allow for fixing and adjustment to the jamb member and reveal) for each planar member 30, 32. One of the planar members 32 includes its body shaped with a recessed portion 50 located between non recessed portions 52. The other planar member 30 has a body shaped as regular planar member.

In this example, each planar member shaped as a rectangle having side edges 54 and end edges 56 whereby the recessed portion 50 is centrally located between the end edges 56 but extends from side edge 54 to opposing side edge 54. Recessed portion 50 has a recessed end edge 58 which comprises a curved border, Recess portion 50 has a depth dimension 60 commensurate with the thickness dimension 42 in the same second plane 44. Depth dimension 60 is greater than the thickness dimension 42.

Outer apertures 48 are sized spaced to receive a suitable fastening member 61 there through to affix each planar member 30, 32 to the opening end face 18 or outer jamb face 16. The middle aperture 49 is sized and located to provide for the location and fixing or mounting of the adjustment means to one of the planar members 30, 32.

Adjustment means 34 as shown in this example includes a bolt including at least one threaded elongate body member 62 with ends, a head member 64 at one end affixed to second planar member 32 to protrude outwardly from inner planar surface or second surface 38 towards the first planar member 30 and fastening apparatus affixed to first planar surface 36 of the first planar member 30. The elongate body member 62 comprises an elongate rod like member having ends 68, 70 and sides with an outer thread 72. One end 68 of the elongate body member 62 ie distal to the head member 64, has an adjusting end 84 (eg a slot or socket) which protrudes outwardly of front or first planar member 30. The head member 64 in this example is a flat ring member which is located at one end of the threaded elongate body member 62 ie facing the end face 18 of the wall, affixed to first or outer surface 36 of rear of second planar member 32.

The fastening apparatus includes at least one threaded member eg first nut fastener 66 (or sleeve 104 of FIGS. 16-32) apertured with an internal thread which is fixedly attached by fixing means 67 (eg welding) or integrally formed with or attached to the first surface or front planar surface 36 of the planar member 30 and a second nut fastener 73 located in the clearance space 2 but abutting inner planar surface or second surface 38 of the planar member 30 together holding the planar members 30, 32 together. This means that the planar member 30 ie the planar member 30 closest to the door 8 is sandwiched and clamped between first nut fastener 66 and second nut fastener 73 whereby first nut fastener 66 is located within middle access aperture 82 of first support member eg jamb base member 76 which then allows adjustment of the threaded elongate member 62 to cause at a portion of the jamb member 4 to be moved laterally with respect to the wall 12. The second nut fastener 73 is an optional extra fixing means to better guide and hold the threaded elongate body member 62 of the bolt with nut 66, to the front planar member 30 and central or middle aperture 49.

First nut fastener 66 and sleeve 104 have their central aperture co-extensive with the central aperture 49 of the first or front planar member 30 which is also threaded internally to be continuous with the internal thread of the nut fastener 66. The internal thread extends through the inside of nut 66 and sleeve 104 and through the thickness of the front planar member 30. The nut 66 and sleeve 104 have a length less than the base member thickness 15 of the support member 4 being moved or adjusted ie eg of base member 76 of jamb member 4—as can be seen in FIGS. 7, 9, 14, 15, 31, 32, the length is shown as being recessed within central access aperture 82.

As shown in the drawings, adjustment means 34 is assembled and configured whereby the threaded head member 64 via an end of the threaded member 62 as attached to rear planar member 32 to be able to freely rotate thereabout (but is not threaded to the rear planar member 32) but not move along its length from the rear planar member 32 or wall 12. The threaded member 62 is attached to one of the other planar member ie front planar member 30 with its own nut aperture 82 aligned or coaxial with the middle aperture 49 and access aperture 82 of the jamb member 4 or base member 76.

The adjustment means 34 is inserted through middle aperture 49 of the rear planar member 32 with the recessed portion 50 whereby the threaded head member 64 is attached 74 to the recessed portion 50 of the rear planar member 32 and the rest of the elongate body has a protruding portion there through.

The protruding portion of the threaded elongate body 62 is then slid through the middle aperture 49 of the other planar member 30 and through the nut aperture 49 of the nut to cause the adjusting end 84 protrude or be accessible through access aperture 82, for adjustment to thereby clamp planar member 32 between the nut and threaded head member 64. As shown in the drawings the planar members 30, 32 are oriented to cause the rows of apertures 43 and 43' of one of the planar members 30, 32 to be oriented in a similar row but oriented at right angles to the apertures 48, 49, 128 of the other planar member 32, 30 but with the middle apertures 49 being co-aligned.

Figure 6:
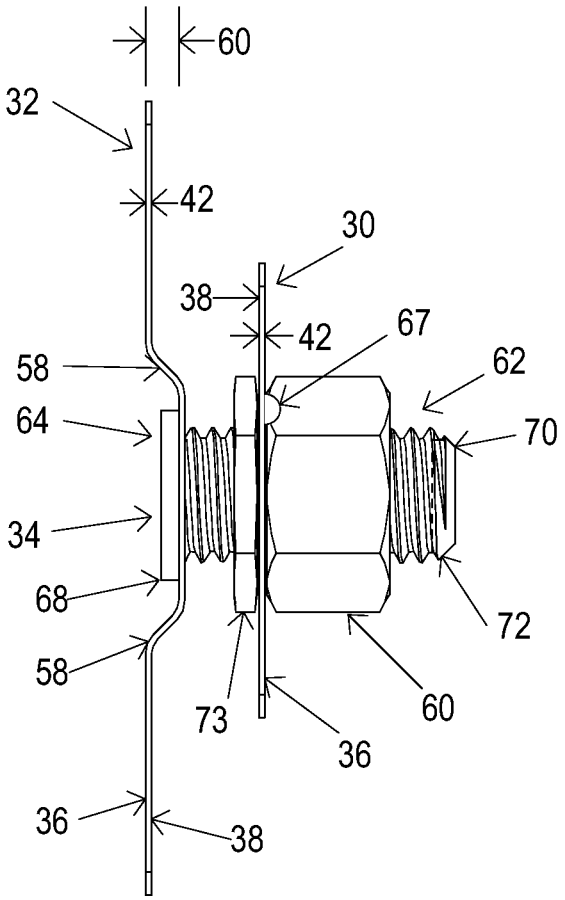
Figure 7:
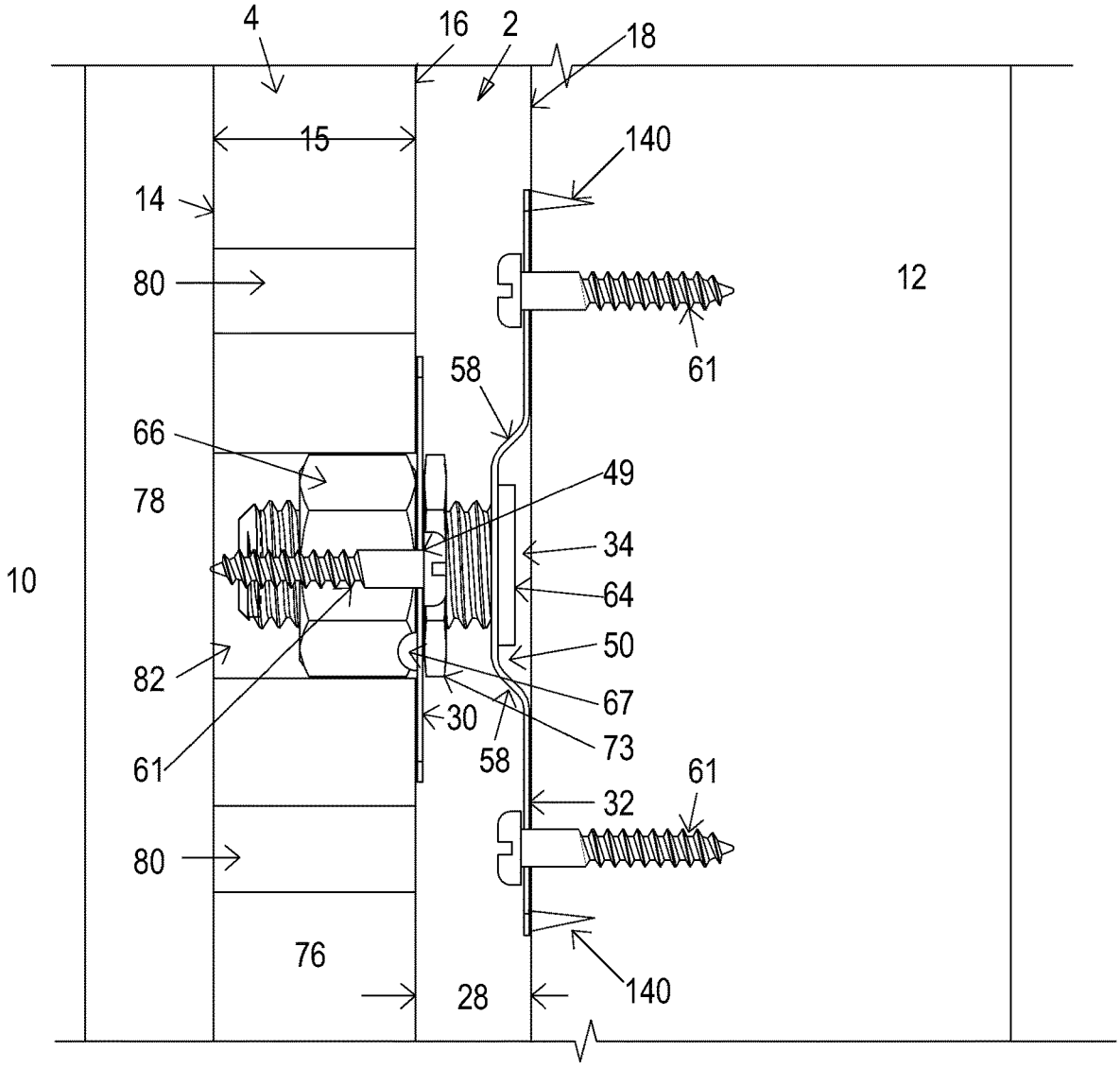
Figure 8:
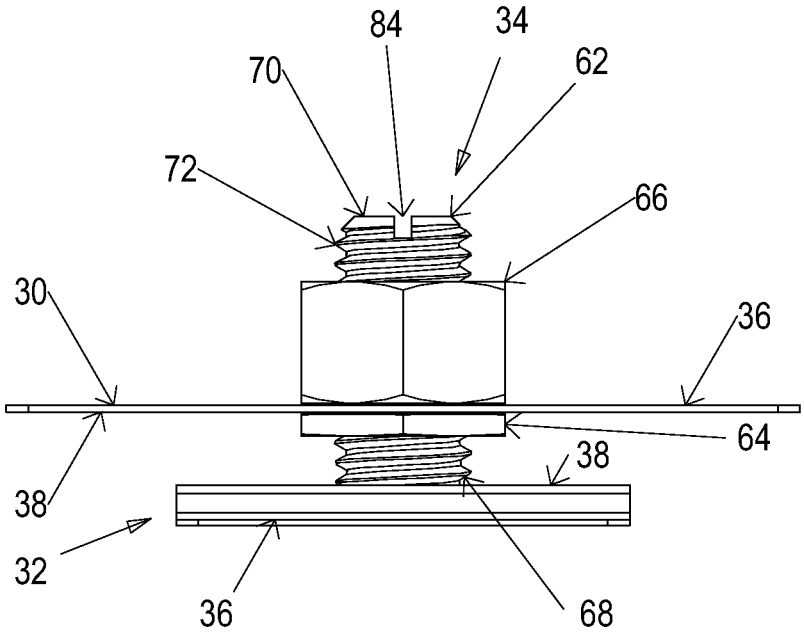

In use the recess portion 50 of the rear planar member 32 and rear planar surface ie first surface 36 faces and abuts the opening end face 18 of the opening 10 with non recessed portions 52 abutting and being affixed to the opening end face 18 of the opening 10. The other planar member ie front planar member 30 is slidably and threadably attached to the rear planar member 32 to be affixed to the outer jamb face 16 of the b. The purpose of the depth 60 of the recess portion 50 is to receive and accommodate the head member 64 of the adjustment means 34 so as to no protrude beyond the rear planar member 32 and into the wall face 18 of the wall. As can be seen in FIGS. 6 and 7 a depth of the head member 64 is at the very least smaller than the depth dimension 60.

Jamb member 4 in this example which can be made on site or provided by a door manufacturer, is a door jamb comprising a top portion and side portions with each portion comprising a base member 76 and an attachable stop member 78 with one portion of the jamb member having a hinged side and the other side not being a hinged side.

The bolt having a threaded body member 62 has a length between the ends that is greater than the depth of the clearance space 2 but is less than the depth or thickness of the combined clearance space 2 plus the thickness of the jamb base member 76. Though if the length of the bolt is too long then it can be shortened to suit requirements to either not protrude or allow the stop member 78 to cover it.

As shown in FIG. 7 the base member 76 has suitably sized and positioned (eg vertically) base member access apertures 80 and 82 in a row whereby outer apertures 80 are for providing access to the fasteners for the rear planar member 32 for affixing to the end face 18 of the wall 12 and central aperture 82 is for allowing access for adjustment of the elongate member 62 of adjustment means 34 of the adjustable packer apparatus 1 to move the jamb member 4 via the base member 76 levering about the fixed or stationary stud 26 of the wall 12. The actual adjustment is done by inserting an operating tool eg screw driver, through middle aperture 82 and into an adjusting end 84 (eg slotted) of end 70 of the threaded elongate member 62.

The adjustment caused by the apparatus 1 of the present invention, is oriented in a plane parallel with the length the of adjustment means 34 whereby the threading rotational movement of the adjustment means 34 about a fixed length position in a rear face ie first surface 36 of the second or rear planar member 32 at one end, and threadably within the fastening 66, 104 in the first or front planar member 30 at the other end, causing the front planar member 30 to move and adjust the support member or jamb base member 76 to be pushed or pulled in at least a portion of the jamb base member 76 with respect to the fixed and stationery support member ie wall 12 with the second or rear planar member 32, thereby altering the dimension of the clearance 2 there between the planar members 30, 32 and support members ie jamb base member 76 to wall 12.

After adjustment by rotating the threaded elongate member 62, the stop member 78 can be attached within the opening to cover the access apertures 80 and 82 in the base member 76 of the jamb member 4 and provide a stop or abutment to hold the door closed in the opening 10.

Second Embodiment—FIGS. 16-32

Similar to the other embodiment this apparatus 1 is useful for but not limited to, being used for adjusting one member 4 with respect to and spaced from as clearance space 2 having a thickness dimension 28, to another member 12 like for example a door jamb frame 4 spaced about a certain distance like about 10-20 mm from an end face 18 of wall opening 10 of a reveal stud 6 of frame 12.

Using similar labelling numbers for similar components and parts of components of the apparatus 1 which also includes planar members 30 and 32, adjustment means 34, apertures 48, 49, 128 and fasteners 61. The planar members 30, 32 can include plate like members and include ie front planar member 30 which in use has a first planar surface or first surface 36 which abuts and is removably affixed to an outer side 16 (facing edge 18 of the wall frame face of the opening) of the door jamb base member 76 (and a second planar surface or second surface 38 which faces the opening 10) and rear planar member 32 which in use has a first planar surface 36 abuts and is removably affixed to an outer side 18 (facing the door jamb 4) of the reveal or stud of wall frame 12 facing of the opening 10 and a second planar surface or second surface 38 which faces the clearance space 2 and the other second planar surface or second surface 38 of the planar member 30.

The use of aperture(s) outer apertures 48, and central aperture 49 substantially in a row for each planar member 30, 32 with respect to each other and the planar members 30, 32 is also the same for the first and second embodiments. Apertures 48, 49, 128 for each planar member 30, 32 are oriented in one row (or close to being a row) being at an angle (eg right angles) to the other row of apertures 48, 49, 128 that allows (after fixing the front planar member 30 to a back of jamb base member 76) access to insert and adjust suitable fasteners therein and/or there through, to the rear planar member 32 to affix the rear planar member 32 to the wall stud frame. One support member 4 also has access apertures 80 and 82 ie outer access apertures 80 and middle access aperture 82 and there is adjustment means 34 also comprising a bolt 62 with a head end 64.

Figure 30:
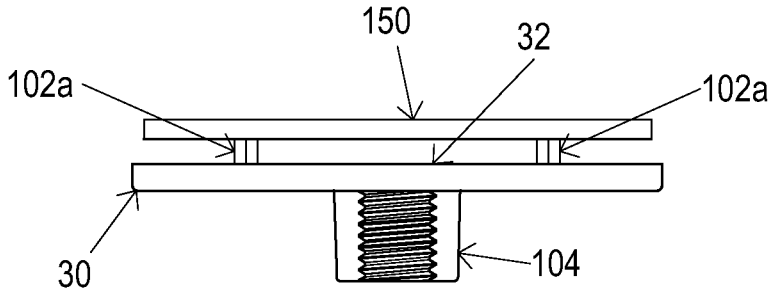
Figure 31:
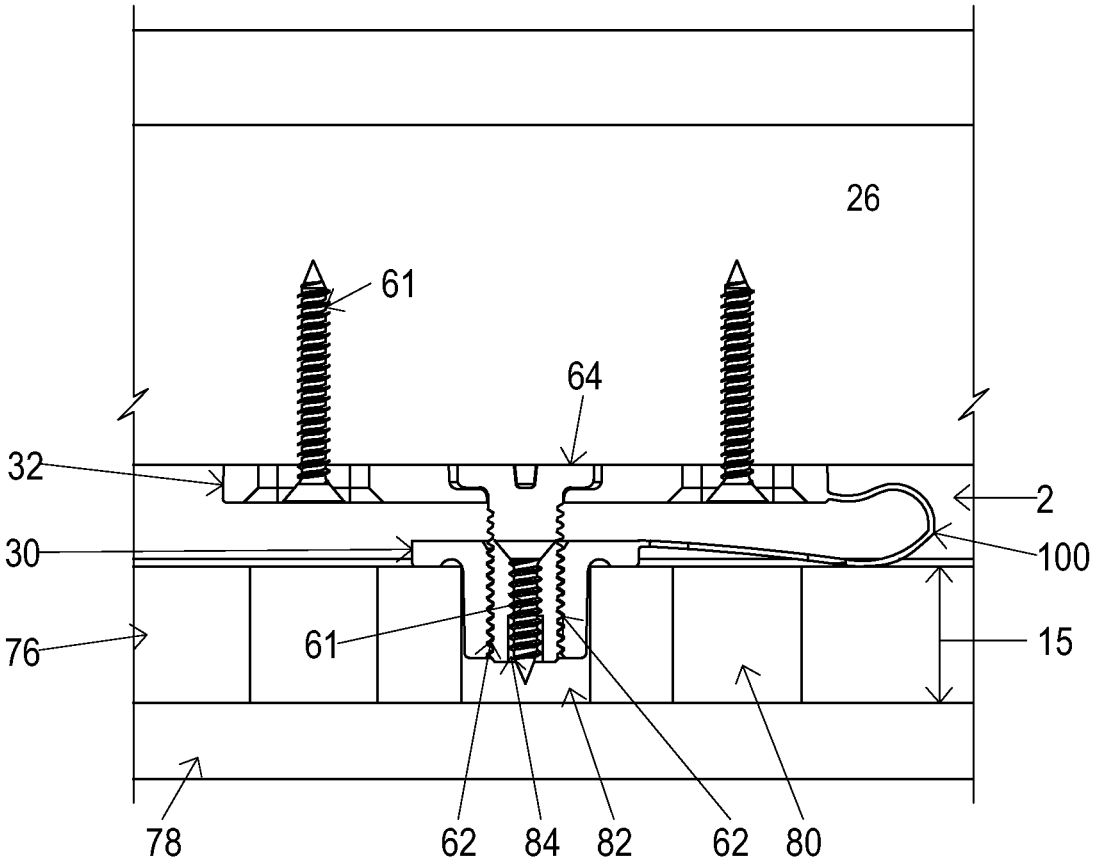

The main differences from the first embodiment is that:

- the first and second planar members 30, 32 are joined, connected, linked or integrally formed together by a suitable joining means 100 (eg a strap),
- the rear planar member 32 does not have a bent middle portion ie recessed portion 52 but is formed as a single 'un-bent' or straight planar member 32 having a thickness 42 to include and accommodate at least one enclosed central cavity portion 102 therein to capture the head of an adjustment bolt 62,
- for the adjustment means 34, the threaded member ie nut fastener 66 is replaced by an internal threaded sleeve 104 in the same position on a front face or first surface 36 of the first planar member 30 which is accessible through the central aperture 82 of the jamb base member 76 as shown in FIG. 7, from the opening for the door between the door jamb base member 76,
- for the adjustment means 34, the threaded member 62 with an attached head washer 64 is replaced with a one piece threaded adjustment means 34 eg bolt (see FIGS. 21-26) having a head 64 and elongate threaded body 62 whereby the head 64 is held or captured within the enclosed central cavity portion 102 and adjusting end 84 (eg allen) is provided at the non head end to allow one to adjust the threaded member 62 as required. (as shown in FIG. 30 the enclosed cavity portion 102 can be formed simply by providing a raised peripheral ring formation 102*a* formed or joined to outer or rear surface or first surface 36 of the rear planar member 32)

The apertures 48 for the rear planar member 32 are shown as being slotted apertures 128 to allow the rear planar member 32 to be adjustably moved vertically or allow a suitable fastening to be positioned in different positions as required.

Front or first planar member 30—is rectangular in shape having a width 110, length 112 and thickness 114. In this example, front planar member 30 can be 30 mm wide×70 mm long×3.5 mm thick with three apertures 48, 49, 128 spaced along the length (in use being horizontal), whereby the two outer apertures 48 being 50 mm apart, typically the two outer apertures 48 are much less in diameter that the central aperture 49. The outer apertures 48 function to provide for insertion of fasteners 61 to fasten the front planar member 30 to the rear face 16 of the door jamb base member 76 while a central aperture 49 is sized to allow for the adjustment travel of the fastening member of adjustment means 34 ie fastening member eg M10, being approximately 10+3.5 mm long, there through.

Rounded corners of say 2 mm dimeter can be utilized as well and the apertures 48 can be bevelled at an entrance to facilitate a more flush outer surface when fasteners 61 are being used.

Rear or second planar member 32 is also rectangular in shape having a width 120, length 122 and thickness 124—eg 30 mm wide×80 mm long×5 mm thick with a central circular aperture 49 between outer apertures 48 in the shape of slotted apertures 128 (in use being vertical as seen in FIGS. 16-19, 27), with the slots being about 10 mm long. Outer apertures 48 are spaced 45.80 mm to 66.20 mm apart and about 5 mm from each edge. The width of the slotted apertures 128 being similar to the width or diameter of the central aperture 49. Rounded corners of say 2 mm dimeter can be utilized as well and the outer slotted apertures 128 can be bevelled at an entrance end to facilitate a more flush outer surface when fasteners 61 are being used.

In this embodiment the adjustment means 34 includes a threaded sleeve 104 (comparable to fastening nut 66) being approximately 12 mm in length 129 being of a dimeter 129*a* commensurate with the diameter of the central aperture 82 of the front planar member 30 to allow the elongate threaded body 62 (eg M10) of the adjustment means 34 to adjustably travel there through the front planar member 30 and sleeve 104 to be seen and allow adjustment of the front planar member 30 and attached jamb base member 76.

The joining means 100 is shaped as at least one elongate planar member having a length 130, width 132 and thickness 134 dimension and at least one slot 136 therein. The length dimension 130 of the joining means 100 is determined by the distance or clearance 2 required between the planar members 30, 32 and the typical distance or clearance 2 required between the door jamb member 4 and opening reveal 12, and thickness dimensions of the front and rear planar members 30, 32. The position of the joining means 100 can be located where ever is convenient ie on or from the bottom or top of the front or first planar member 30 to a top or bottom of the rear or second planar member 32 or one can simple rotate to the apparatus to have the joining means 100 on top or bottom.

The thickness 124 of the rear planar member 32 is also determined by the depth required for capturing the head 106 of the adjustment means 34 which must be deep enough to hold the head 106 and yet at the same time allow the head to rotate with its elongate body, in a fixed length position at the head end, to cause the adjusting/moving of the linked adjacent portion of the door jamb member 4.

For example if the clearance 2 is about 20 mm the length of the adjustment means 34 or bolt 100 can be of a length of about 40 mm.

In one example, this joining means 100 includes a shape with a thickness 134 and width 132 with the width 132 most likely no greater than the width 120 eg 30 mm, of the front or rear planar members 30, 32 or less than that width of each planar member. Joining means 100 functions to be flexible enough to allow bending there about to enable the planar members 30, 32 to fitted parallel with each other in the clearance space 2 and to be able to hold the planar members together during manufacture, moulding, transport, adjustment and handling. The width 132 can be selected to allow the joining means 100 to be more flexible than the planar member 30, 32 (eg be less than the thickness 114, 124 than the thickness of each planar member) which can make the thickness 134 to be less eg 0.8 mm.

The length 130 of the elongate body of joining means 100 is selected to be greater than the clearance 2 dimension between the jamb base member 76 and wall 12 forming a drooping shape that allows for the adjustment there through while retaining the joining of the planar members 30, 32 to each other. For example as shown in the figures, the length 130 can be 56 mm and the slot 136 can be for example 7.5 mm wide 138 by 26 mm long 140 and is positioned on the strap to be accessible there through for any suitable fastening tool and fastener 61 there through to the lower slotted aperture 128 of the rear planar member 32 there behind, affix at least one suitable fastener 61 through the rear planar member 32 to fasten the rear planar member 32 to the reveal of the adjoining wall 12.

Adjustment with Adjustment Means 34—how it Works

During adjustment ie rotation initiated from/about adjusting end 84 of at least one bolt 62, either clockwise or anti-clockwise, of the bolt 62 which threadingly moves and travels through the nut/sleeve 66, 104 while head end 64 of the bolt 62 is held longitudinally positionally there about but is rotatable there about, rear planar member 32, optional backing plate and wall 12, is immovable or not readily deformable in comparison to the front planar member 30 and jamb member 4 or base member 76, to cause the front planar member 30 with its nut 66 sleeve 104 with the jamb member or base member 76 to move accordingly to either narrow or widen the clearance gap 2 between the front and rear planar members 30, 32 and between the jamb member 4 or base member 76 and the wall 12 or optional backing plate.

Narrowing the Clearance Gap 2 turning/rotating (eg anticlockwise or clockwise) of the bolt 62 towards the front planar wall 30/jamb member 6 or base member 76 (away from the wall 12/rear planar wall 32) because the wall 12 and rear planar member 32 is relatively immovable as compared to the jamb member 4 or base member 76 and the head 64 is freely rotatable within the rear planar member 32 but not longitudinally movable, this bolt turning causes the head 64 of the bolt 62 to pull against the screw fasteners of the rear planar member 32 while threading through the nut/sleeve 66, 104 of front planar member 30, which draw or pulls in the jamb member 4 or base member 76/front planar member 30 towards the wall 12 or rear planar member 32 while the bolt threadingly travels towards and through the front planar member 30, causing an end of the bolt to be protruding within nut 66/sleeve 104 access aperture 82.

Expanding the Clearance Gap 2 turning/rotating (eg clockwise or anticlockwise) of the bolt towards the rear planar member 32/wall (away from the front planar member 30/jamb member 4 or base member 76) but because the wall 12 is relatively immovable as compared to the jamb member 4 or base member 76, and the head 64 is freely rotatable within the rear planar member 32 but not longitudinally movable, this bolt turning causes leveraging or pushing of the bolt head 64 against the wall 12/rear planar member 32, while the bolt is threadingly travels away from and through nut/sleeve 66, 104 of the front planar member 30 in the opposite direction, to push or draw the front planar member 30/jamb member 4 or base member 76 outwardly away from the rear planar member 32/wall 12, causing an end of the bolt to not protrude from nut 66/sleeve 104 within access aperture 82.

Example Methods of Installation

Example methods are disclosed which show how the adjustment apparatus of the present invention can be used to simply adjust any two adjustment members or support members having a clearance space 2 there between with one member being stiffer or less flexible than the other. In the methods, the jamb base member 76 of jamb member 4 or frame is installed with at least one apparatus on the rear face 16 of the jamb base member 76 with as many apparatus as required ie typically three each on each side with none on top unless the opening is wide eg double doors might require eg two apparatus. There is no need for any other fasteners eg nails or wedges other than the apparatus 1 of the present invention. Typically the hinged side is done first by levelling or plumb vertically and horizontally the door and jamb member or frame 4, with possibly with some optional adjusting using adjustment means 34 of the apparatus 1 and then other side ie non hinged side is done which usually includes more or most of the adjusting ie of suitable adjustment using adjustment means 34 of the apparatus 1 is done with or without adjustment of the jamb member using the slotted apertures 128 or pivoting about one screw. In these particular examples, the adjacent members being adjusted, happen to be support members in an opening in a wall.

A First Method of Installation

In a second aspect, the invention resides in a method of installation of the invention of an adjustable packer apparatus for adjustably adjusting a clearance space 2 between members of the apparatus and when in use between at least two support members 4, 12 of at least one side of wall opening eg hinged side, wherein the method includes the following steps of:

1. Assemble or provide at least one adjustable packer apparatus 1 including planar members 30, 32 (eg first or front planar member 30 and second or rear planar member 32) and adjustment means 34;
2. Provide at least one support member 4 ie at least a jamb base member 76 for positioning adjacent another support member 6 to provide when fitted to an opening 10 in a wall 12 a clearance space 2 there between (eg support member 4 includes a jamb member including a jamb member 4 including at least a jamb base member 76 and optional a stop member 78);
3. By locating the position of stop member 78, drill vertical oriented spaced holes outer access hole or apertures 80 and middle access apertures 82 to provide co-linear access to the holes/apertures 48 of the rear planar member 32 when being attached to the stud of the wall frame 12;
4. Install adjustable packer apparatus 1 to rear face 16 of jamb base member 76, by fixing fastening fasteners 61 through horizontal oriented apertures 48 of front planar member 30 to back face 16 of one of the support members 4 eg jamb base member 76 of jamb member 4;
5. Positon jamb base member 76 with attached front planar member(s) 30 to rear face 16, into opening 10 of wall 12 to create clearance space 2 there between base member 76 and support member 12;

6. Affix rest of adjustable packer apparatus 1 by fastening, fasteners 61 through vertically oriented access apertures 80 of rear planar member 32 to end face 18 of the other support member (eg stud 26 of wall 12);
7. Operate adjustable packer apparatus 1 to adjust the size of the clearance space 10 by initiating adjustment means 34 via adjusting end 84 of threaded elongate member 62 through middle aperture 82 and through nut fastener 66 or threaded sleeve 104, to cause one of the support members 4 and one of the planar members 30 to move with respect to the other support member 12 and other planar member 32;
8. Optionally affix stop member 78 in place on jamb base member 76 of jamb member 4 to cover access apertures 80, 82.

A Second Method of Installation

1. Assemble or provide adjustable packer apparatus 1 with first or front and second or rear planar members 30, 32 and adjustment means 34;
2. Provide one support member 4 in the form of a jamb frame including at least a jamb member 4 comprising jamb base member 76 and stop member 78;
3. By locating the position of stop member 78, drill access holes or apertures 80 and middle hole or aperture 82 to provide co-linear access to the holes/apertures 48 of the rear or second planar member 32 being attached to the stud of the wall frame 12;
4. Install adjustable packer apparatus 1 to rear of jamb base member 76, by fastening fasteners 61 through outer apertures 80 of planar member 30 to back 16 of base member 76 of jamb member 4;
5. If apparatus 1 is formed of separate planar members 30, 32 then put jamb base member 76 of jamb member 4 and adjustable packer apparatus into opening 10 of wall 12 forming clearance space 10 there between;
6. Affix adjustable packer apparatus 1 by fastening, fasteners through outer apertures 80 of second or rear planar member 32 to end face 18 of stud 26 of wall 12;
7. Operate each adjustable packer apparatus 1 to adjust clearance space 2 as required, by initiating adjustment means 34 via adjusting end 84 of threaded elongate member 62, 101 through middle aperture 82;
8. Put stop member 78 in place on jamb base member 76 of jamb member 4 to cover the vertical oriented apertures 48 and middle aperture 82 and adjustment means 34;
9. Optionally after installation of the planar members 30, 32 on the jamb base member 76 and wall 12, the planar members 30, 32 are trimmed to remove any protruding portion(s) from the width of the jamb base member 76 and the thickness 47 of the wall 12.

A Third Method of Installation—Top and Non Hinged Side

1. Provide at least one adjustable packer apparatus 1 for adjusting one support member 4 with respect to another support member 12 wherein each apparatus includes planar member 30, 32 and adjustment means 34, wherein the planar members 30, 32 have middle apertures 49 between outer apertures 48 and the support members includes a wall with an opening for a door and a jamb base member 76 including door jamb base members 76, on top and sides of a door jamb frame whereby the sides of the jamb frame include hinged and non hinged sides with at least one apparatus 1 per hinge and non hinged sides as required,
2. Each base member 76 of jamb member 4 is provided with suitably spaced three vertically aligned access apertures or holes 80 (top and bottom), 82 (middle) to be located wherever the adjustable packer apparatus 1 are to be located eg at the top, middle and bottom of a door jamb base member 76 between the base member 76 and wall 12 whereby one aperture ie middle aperture 82 between two outer apertures 80 (top hole & bottom hole) is for the adjustment means 34 ie threaded elongate member 62 and the outer two apertures 48 are for accessing the fixing of rear or second planar member 32 of the adjustable packer apparatus 1 to the end face 18 of wall 12;
3. Attach each adjustable packer apparatus 1 to a rear of jamb base member 76 of jamb member 4 by attaching fasteners 61 through a first or front planar member 30 to a rear face 16 of the base member 76 of jamb member 4 ie attach each adjustable packer apparatus 1 to suitable positions on the rear of jamb base member 76 ie eg top, middle and bottom of rear face 16 of jamb base member 76 of at least the non hinge side, (and optionally to the hinged side) whereby the two outer horizontally oriented apertures 48 of the front planar member 30 are screwed there through to at least the non hinge side portion (eg face 16) of the jamb frame 4 at the pre-hung door factory and the attachment means 34 is located within the middle access aperture 82 of the jamb base member 76 to be accessible there from and within; then the pre-hung door 8 would be assembled as normal to the jamb member as a frame, then be ready for delivery to site. And similarly for the hinged side jamb portion and optionally the top portion could also have adjustable packer apparatus 1 fitted also.
4. Once on site containing the other support member 12 having opening 10, the hinged side of the jamb frame 4 is attached to the end stud 26 of the wall frame 12 utilizing several apparatus 1 which are positioned and fixed away from the hinges whereby the jamb member is adjusted vertically to be plumb and horizontally to fit within the walls thickness as required;
5. At the top of the jamb frame 4 this is fixed next, by checking the door 8 had a correct gap or clearance space 2 across the top and wedging up with apparatus 1 if needed;
6. Then for non-hinged side, align a top adjustable packer apparatus 1 (ie top side portion of the jamb base member 76) vertically with the stud 26 by then winding one adjustable packer apparatus 1 (ie near the top of base jamb 76) until one end 68 of threaded elongate member 62 hits/abuts the stud 26 (ie face 18) and fix the-(rear) planar member 32 of the adjustable packer apparatus 1 with a screw 61 using a top hole 80 through the jamb base member 76 for access to top hole 48 of the rear planar member 32 which allows horizontal adjustment of the jamb member pivoting about the top screw;
7. For the non hinged side, next align for the bottom adjustable packer apparatus 1, the bottom side portion of the jamb base member 76 vertically with stud 26 by then fixing the top of this adjustable packer apparatus 1 with screw 61 using a top hole 80 through the jamb base member 76 for access to a top hole 48 of the rear planar member 32 which allows horizontal adjustment of the jamb member pivoting about the top screw;
8. Next fix the top adjustable packer apparatus 1 at the centre of this adjustable packer apparatus 1 with a screw 61 using a top hole 80 through the jamb base member 76 for access to the top hole 48 of the rear planar member 32;

9. Finish fixing the top adjustable packer apparatus 1 minor movement can be made sideways or horizontal just by tapping the jamb member 4 or base member 76 across, then fixing the bottom of this adjustable packer apparatus 1 with a screw 61 using the bottom hole 80 though the jamb base member 76 for access to the bottom hole 48 of the rear planar member 32;
10. Fixing the middle adjustable packer apparatus 1 minor movement can be made sideways just be tapping the jamb base member 76 across then fixing the bottom of the middle adjustable packer apparatus 1 with a screw 61 using the top hole 80 through the jamb for access to the top hole 48 of the rear planar member 32 and the bottom hole 80 through the jamb for access to the bottom hole 48 of the rear planar member 32;
11. Finish fixing the bottom adjustable packer apparatus 1 minor movements can be made sideways or horizontal just by tapping the jamb base member 76 across then fixing the bottom of the bottom adjustable packer apparatus 1 with a screw 61 using the bottom hole 80 though the jamb base member 76 for access to the bottom hole 48 of the rear planar member 32;
12. Now all adjustable packer apparatus 1 (at the top of the door and top, middle and bottom for non hinged side) are secured, then close the door 8 checking the gap or clearance space 2 between the edge of the door 8 and the jamb base member 76, adjust the top middle and bottom adjustable packer apparatus 1 using the adjusting screw 62, 101 to get the correct gap and tighten the (cocking) nut fastener 66 if fitted to hold secure;
13. Door gaps 2 can be adjusted at any time before the architraves (not shown) are installed to cover these gaps 2;
14. Door stop member 78 can now be installed around the door 8 covering the fixing and adjustment holes 80, 82.

In other options after installation of the planar members 30, 32 on the base member 76 of jamb member 4 and to wall 12, the planar members are trimmed to remove any protruding portion(s) from the width of the jamb and the thickness of the wall.

In any of the methods, after installation of at least one apparatus 1 in the clearance space 2 between the jamb base member 76 and wall 12, before fixing the rear or second planar member 32 to the face 18 of wall 12, suitable adjustment of the position of the jamb base member 76 can be made vertically using the apertures 48 which are slotted apertures 128 or horizontally by locating but not first fixing one fastener 61 in the top or bottom apertures 48 of each apparatus 1 which allows at least the jamb base member 76 to be moved or rotated horizontally so many millimetres distant from but about the one screw 61 and then the fasteners 61 through slotted apertures 128 can be finished by screwing the rear planar member 32 properly to the face 18 of wall 12.

With or without the joining means 100, in any of the above methods, any suitable abutment means can be inserted in the wall beside the length of the rear planar member 32 to at least reduce any turning or unwanted repositioning of the rear planar member 32, when the front planar member 30 is being installed and/or adjusted ie before the fixing of the rear planar member 32 to the wall.

Optional Advantages a) Is readily adjustable
b) Very modest cost to retail
c) Simple use or installation
d) Simple installation process
e) Speeds up construction times
f) Very modest cost to manufacture
g) Either planar member can be attached to rear of jamb
h) Either planar member can be attached to the wall
i) adjustable packer apparatus 1 can be reused
j) Can be made in a variety of sizes and shapes
k) Speeds up door or window installation
l) Is able to be used with any type of jamb
m) One piece or linked construction between the planar member
n) Rotating the adjustment means does not cause planar member on wall stud to rotate
o) One piece or linked construction better enables removal from moulds during manufacture, easier to retrieve, easier to transport and easier to make adjustment to one planar member without moving the other planar member
p) Recessed to house one end of adjustment means to allow rotation thereabouts but in a fixed position in one of the planar members
q) Recess can be formed as a space, cavity or as a bent portion of one of the planar members
r) Planar members can be of similar shape
s) Is able to be used with a timber and/or metal jamb
t) A plurality of the packer apparatus can be used per location/door/window
u) Able to be used for any adjustment of closely spaced members
v) Door stop member 78 is used to cover up access holes 80, 82, through base member 76
w) After installation of the planar members on the jamb and wall the planar members can be trimmed to remove any protruding portion(s) from the width of the jamb and the thickness of the wall
x) Abutment members (eg a stud, screw, pin or nail) is/are inserted, driven or screwed beside the length dimension of the rear planar member to prevent rotation of the rear planar member when the front planar member, fastening means or adjustment means are being inserted, fitted or adjusted into place on and with respect to the jamb 4.
y) After installing apparatus 1 with jamb base member 76 and door, in clearance space 2 there between in a wall opening, the jamb base member 76 can be adjusted vertically using slotted apertures 128 in rear planar member 32 and horizontally by rotating about one fixed fastener 61, in rear or second planar ember 32.

Variations

Throughout the description of this specification, the word "comprise" and variations of that word such as "comprising" and "comprises", are not intended to exclude other additives, components, integers or steps. The door jamb member 4 can be formed of any suitable material such as timber, metal or plastics and the orientation of the row of apertures in the planar members need not be truly horizontal or vertical as it is more important that they fit the width of the jamb base member 76 and wall 12 rather than needing to be in a neat straight row. The apparatus 1 of the present invention can be used to move any members that allow movement of one member relative to the other member—the components of the apparatus can be adapted by size dimensions orientation, shape and number for that use.

Any of the feature(s) of one embodiment can be swapped or used in any suitable selection for the other embodiment. Though the planar members 30, 32 are shown as being rectangular, other shapes are equally possible as long as the apertures 48 are oriented and spaced to allow drilling there through the jamb member 4 (ie base member 76) to provide access to the clearance space 2 to the reveal of the wall 12 after fastening the front planar member 30 to the rear face 16 of the jamb base member 76. Extra apertures 80 are positioned in the jamb base member 76 to allow access to fastener 61 through the jamb base member 76 (as possibly for one option through the front planar member 30 as long the fastening is not through the fasteners 61 holding the front planar member 30 to the jamb base member 76), for fixing the rear planar member 32 to the reveal 12.

The thickness 42, 114, 124 of the planar members 30, 32 of any of the embodiments cannot be at least the same as or thicker than the gap or clearance 2 (28) between the support members 4 and 12 and the length of the fastener 62 and threaded bolt 101 needs to be longer than the combined: clearance 2 between the jamb base member 76 and wall 12, the thickness 114, 124 of the planar members 30, 32 and length 129 of the fastening nut 66 or threaded sleeve 104 to allow suitable adjustment of the clearance 2 between the support members 4, 12.

The length of the nut 66 and threaded sleeve 104 should be a length less than the depth of the thickness of the jamb member 4 or base member 76 and the depth of the head of the fastener 62, 104 must be equal to or less than the depth of the thickness of the rear planar member 32 and be sufficient size to be able to be held within the central cavity portion 102 or recess 50 of the rear planar member 32 and yet be rotatable therein. The length and dimeter and threading of the nut 66 and sleeve 104 are adapted to threadingly engage with any suitable threading member 62.

In one option the shape of the planar members 30, 32 can be sized and positioned to fit within the clearance 2 without protruding beyond the thickness of the wall 12 or whatever is being adjusted and the width of the jamb member 4 or base member 76, though more importantly the shape can be any shape as long as the rear planar member 32 can be installed or fastened to the wall 12 when the apparatus 1 is in place attached to the rear face 16 of the jamb member 4 or base member 76. This means that the planar members 30, 32 can be same shape being shaped to abut and optionally cover the whole width or less of the jamb member 4 or base member 76 and thickness 47 (with or without coverings 24) of the wall 12 whereby the holes 80 can be simply drilled after the apparatus 1 is attached to the rear face 16 of the jamb member 4 or base member 76, by then drilling through the jamb member 4 or base member 76 (and optionally the front planar member 30) to allow access to the rear planar member 32. This method of drilling afterwards is different to one preferred option of pre-drilling the jamb member 4 or base jamb member 76 and then attaching the front planar member 30 of apparatus 1 to the rear face 16 of the jamb base member 76.

Furthermore having the planar members 30, 32 not overlapping in planar area though preferred is not essential as the drilling can go through the planar members 30, 32 before or after attaching the apparatus 1 to the support members 4, 12. Equally the planar area is shown as not extending beyond the thickness of the wall thickness 47 and width of the jamb base member 76 is not essential or critical, as whatever method is used to attach the planar members 30, 32 to the wall and jamb, any protruding portion of the planar members 30, 32 can be simply trimmed or cut off flush with the outer surface the jamb member 4 or jamb base member 76 and/or wall 12 to allow attachment of any optional clearance covering eg architraving so as to not protrude beyond the width 45 of the jamb base member 76 and thickness of the wall 12.

The support members 4, 12 can be formed of any suitable material and construction that allows suitable adjustment there between such as for example timber or wood, metal, plastics or concrete whereby one of the support members must be stiffer than the other to allow one of the support members 4 or 12 to be able to be moved, deflected or adjusted with respect to the other support member 12 or 4 accordingly eg almost like a leverage type of action.

Threading rotation of threaded bolt 62, 101 as initiated by rotation at the adjusting end 84 eg allen, slotted, phillips, square, torx, or socket etc at the front (in the doorway opening) of a jamb base member 76 of jamb member 4 (with the front planar member 30 fastened behind the jamb base member 76), causes the bolt 62, 101 to rotate about its fixed head end as captured in the rear or second planar member 32 attached to wall 12 which cannot move relatively lengthwise but can rotate there about, whereby the jamb member 4 or base member 76 as fastened to the front planar member 30 is more movable or flexible than the wall 12 and is therefore being one support member 4, caused (by the different relative stiffness-es) to move laterally in preference to the other support member 12.

The thickness of the planar members 30, 32 combined must be less that the clearance 2 leaving a gap between the exposed opposing faces 16, 18 (between the jamb and wall) of the planar members 30, 32, which provides for an exposed section of the length of the fastener 62 to be a maximum space for use as an adjustment depth being measured and adjusting as being at right angles to the planar extent of the faces of jamb base member 76 or face 18 of the wall 12. The thickness must also allow for the head of the other fasteners 61, 101 for planar members 30, 32 to be accommodated in the clearance space 2—unless countersunk.

The position, number and orientation of any of the apertures 48, 49, 128, 80 and 82 can be varied and need not be in a strictly straight row but is more important to have the apertures in the rear planar member 32 to be coincident with the apertures 80 in the jamb base member 76 and the central aperture 49 must be coincident with the central aperture 82 for the fastener 62 and apertures 80 must not be coincident with the apertures of the front planar member 30. Some apertures 48, 128 eg in the front and rear planar members 30 and 32 can be countersunk 142 on at least the inner face or second surface 38—see FIGS. 16, 18, 27-29, 31, 32.

Any number of apparatus 1 of the present invention can be used to move or adjust any portion of an adjacent member eg a jamb member 4 or jamb base member 76 with respect to a wall or portion of a wall 12 whereby one will need one of the planar members and/or support members to be more flexible or movable with respect to the other planar member and or support member. The size or diameter, length, number, size of thread of adjustment means 34 can be varied to suit what is been moved or adjusted. Similarly the thickness and planar area of the planar member 30, 32 will also vary according to what is being move with respect to what.

Alternatively or in combination with the joining means 100, abutment member(s) 140 (eg a stud, screw, pin or nail, lug) is/are inserted, driven or screwed into the wall beside the length dimension of the rear planar member 32 to prevent or reduce rotation, turning or movement of the rear planar member 32 when the front planar member 30, fastening means 61 or adjustment means 34 are being inserted, fitted or adjusted into place on and with respect to the jamb 4.

Fastener(s) 61 are shown as being screws but other suitable types of fasteners are also able to be used in place or in combination with screws such as driven nails, pins etc.

The actual adjustment of a portion of the jamb member 4 with respect to a portion of the wall 12, is oriented at right angles to the width of the jamb ie parallel with the thickness 15 of the jamb 4 and at angles to the thickness of the wall 12 and parallel with the length of the wall 12. Other adjustment can be done for the position of the jamb member 4, after installation of the apparatus in the clearance space 2 between the jamb member 4 or jamb base member 76 and wall 12, before fixing the rear or second planar member 32 to the face 18 of wall 12 but having the apparatus attached on its rear face 16 by its first or front planar member 30. Suitable adjustment of the position of the jamb member 4 or jamb base member 76 can then be made vertically by first loosely locating fasteners 61 in the apertures 48 which are slotted apertures 128 and then moving/adjusting the frame member 4 vertically as required and then finishing fastening the fasteners 61 to the wall 12. Alternatively horizontal adjustment can be done by fixing one fastener 61 in the top or bottom apertures 128 which allows at least the jamb member 4 or jamb base member 76 to be moved remotely therefrom by being rotated or pivoted horizontally about the one screw 61.

The jamb member 4 of the jamb frame can include the stop member 78 being separately formed to the base member 76 though in other variations, the jamb member 4 can be integrally formed with the access holes 80, 82 being drilled though the stop member 78 and base member 76 and then covered up with filler or capping. A backing plate 150 (see FIG. 30) is mentioned in this specification as an optional plate to be affixed to the rear of the rear or second planar member 32, which can function similar to or in addition to wall 12 in providing some further stiffening of the rear planar member 32 with respect to the front or first planar member 30 to facilitate adjustment of the front planar member 30 or jamb member 4 or base member 76.

Furthermore, each row of apertures 48, 49, 128 of one planar member 30 or 32 with regard to the row of apertures 48, 49, 128 of the other planar member 32 or 30, can be oriented at right angles to each other but this is not strictly essential, rather it is the access one needs to be able to affix both planar members to the rear of the jamb and to the end face of the wall 12 with the access apertures 80, 82 that is more important. The shape of the recess 50 can be any suitable shape (eg circular or square etc) that allows for the recessing of end 64 of the adjustment means 34 ie to not protrude beyond the body of the planar member 32. Equally the number of the apertures 48, 49, 128 and access apertures 80, 82 can be varied in shape, orientation and number of.

The adjustable packer apparatus 1 of the present invention is shown as being used for a door jamb, though other uses are also equally possible (eg a window) such adjusting any gap between any two adjacent members. The diameter, size and length of the adjustment threaded elongate member 62 can be varied suit requirements. The size, area and thickness of the planar members 30, 32 can be varied to suit the surface area provided by the thickness of the wall and jamb members.

The number, shape and pattern of apertures 48, 49, 128 can also be varied to suit requirements and also the orientation of one set or row of apertures 48, 49, 128 of one planar member 30 with respect to the other set or row of apertures 48, 49, 128 in the other planar member 32 can be varied. The joining member 100 can be swapped with other means that still connects and holds the members 30 to 32 together and allow access there through for attachment of the rear planar member 32, such as for example strips, wire or rope.

Materially the adjustable packer apparatus 1 can be fabricated from any suitable material or combination of materials, such as metal, plastics or wood. The thickness of the planar members can also be varied to any constant suitable thickness or the thickness can be of a varying thickness eg angled or sloping. The recess portion 50 can also be varied in depth and shape to suit particular or sized fastening of the adjustment means 34.

The orientation of one planar member 30 can be varied with respect to the orientation of the other planar member 32 or vice versa and need not be exactly at right angles to each other though some clearance there between is helpful to allow easier drilling of the access holes 80, through the jamb member 4 or base member 76. Any of the apertures 48, 49, 128 and access apertures 80, 82 can be provided with slotted portions (not shown except in FIGS. 17-30) in certain directions, to allow for adjustment in that direction eg horizontal for sideways adjustment of the jamb member 4 or base member 76 with respect to the wall 12.

Figure 9:
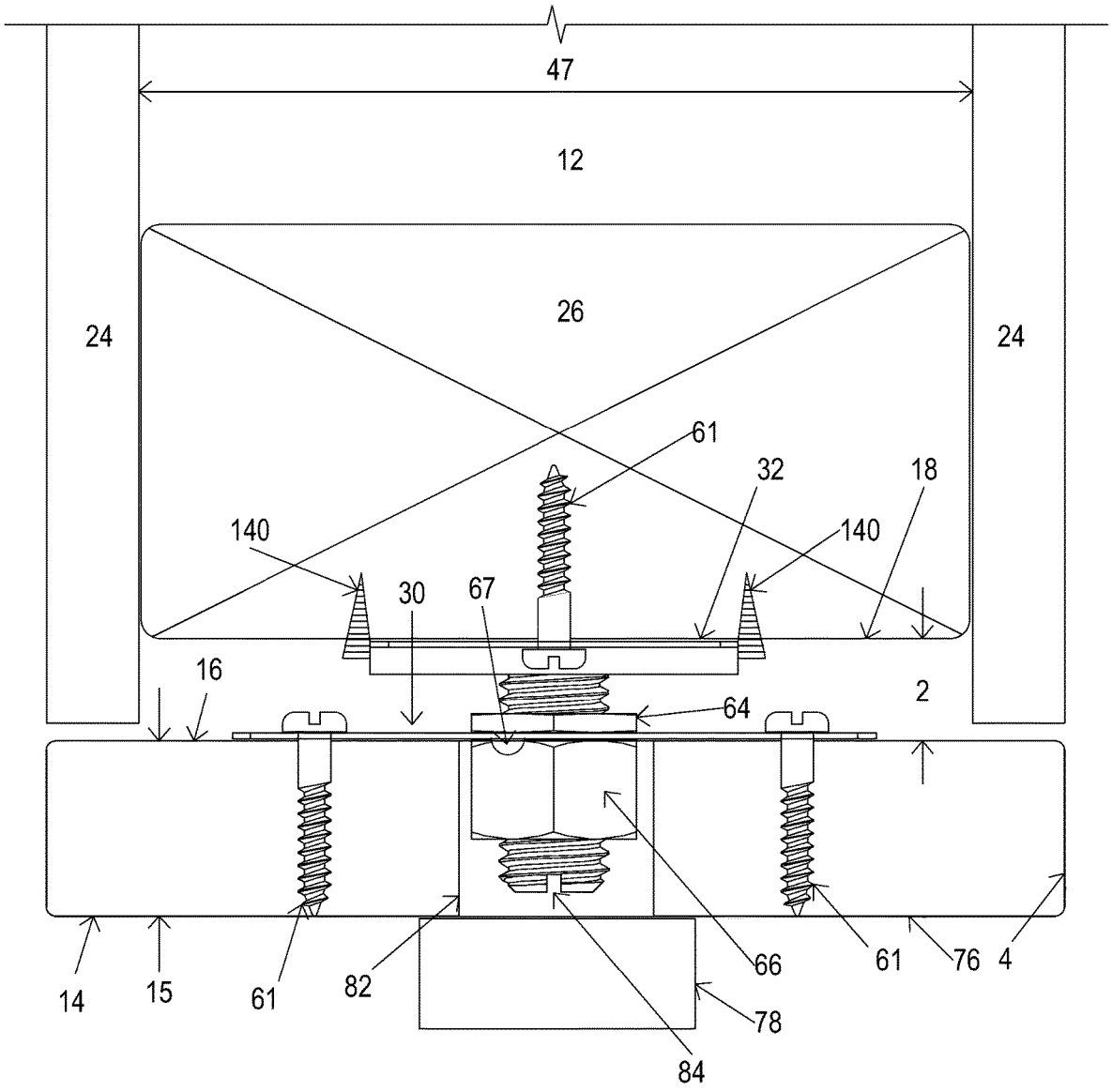
Figure 10:
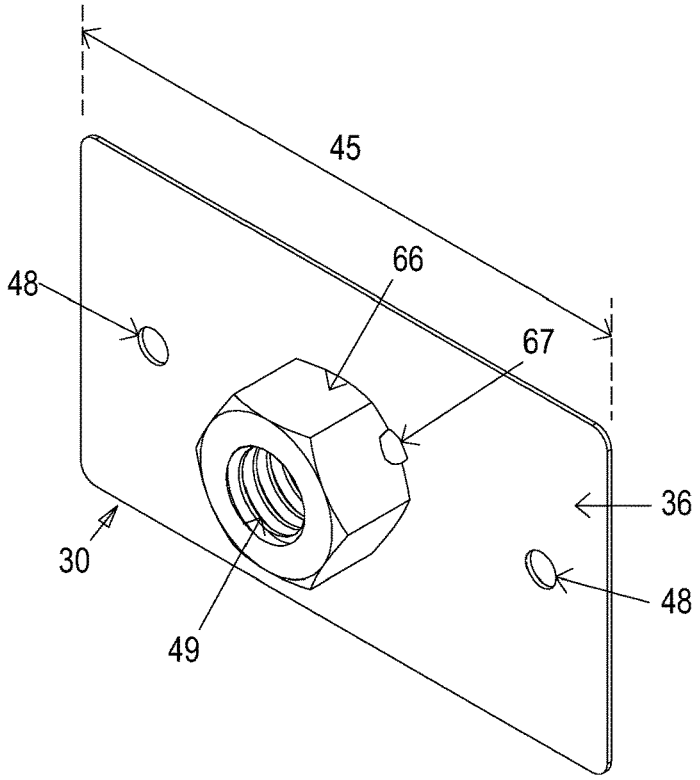
Figure 11:
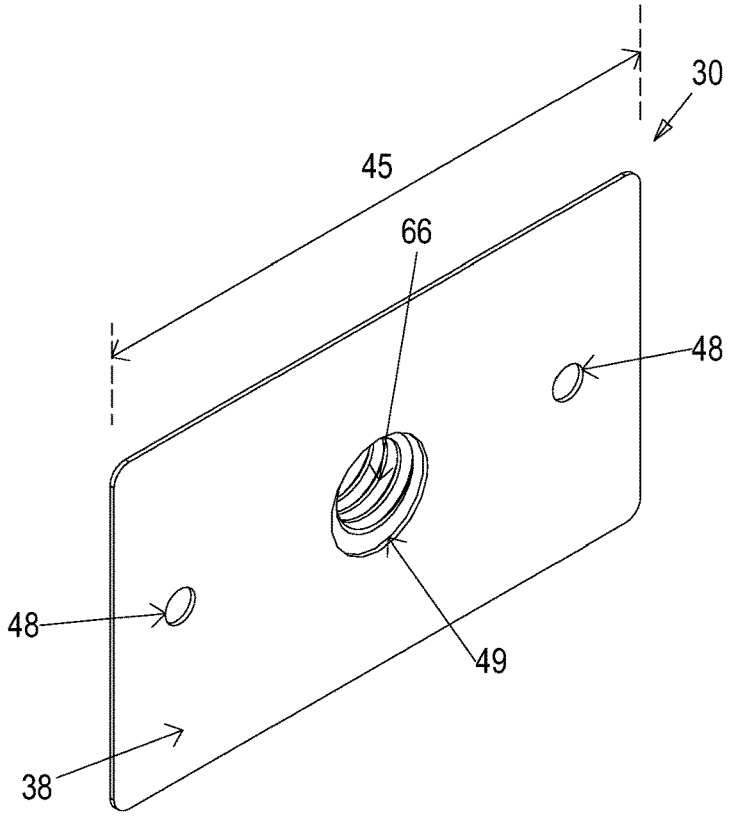
Figure 12:
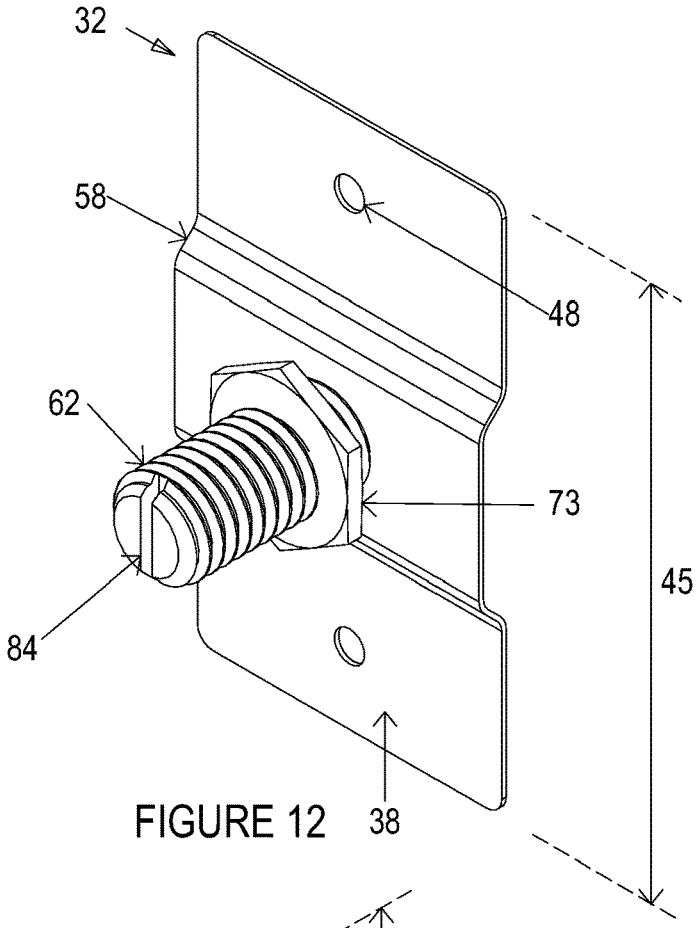
Figure 13:
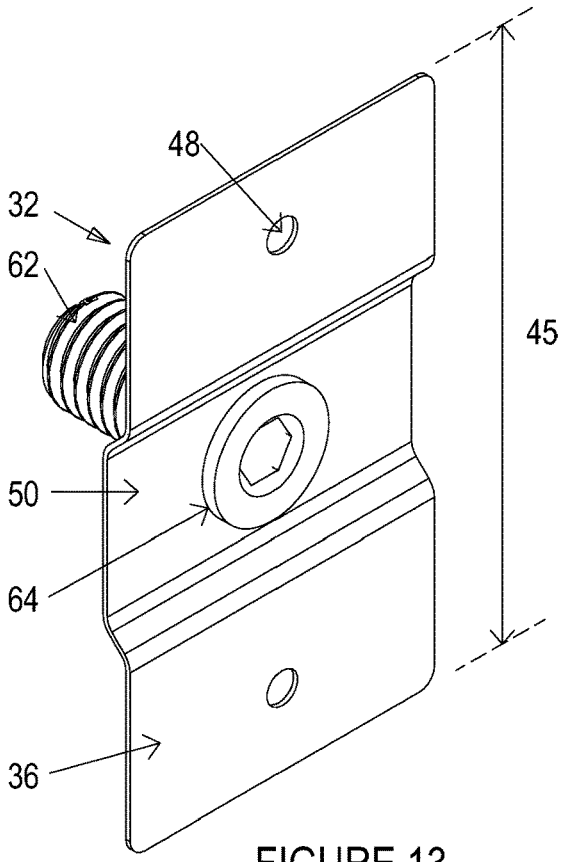
Figure 14:
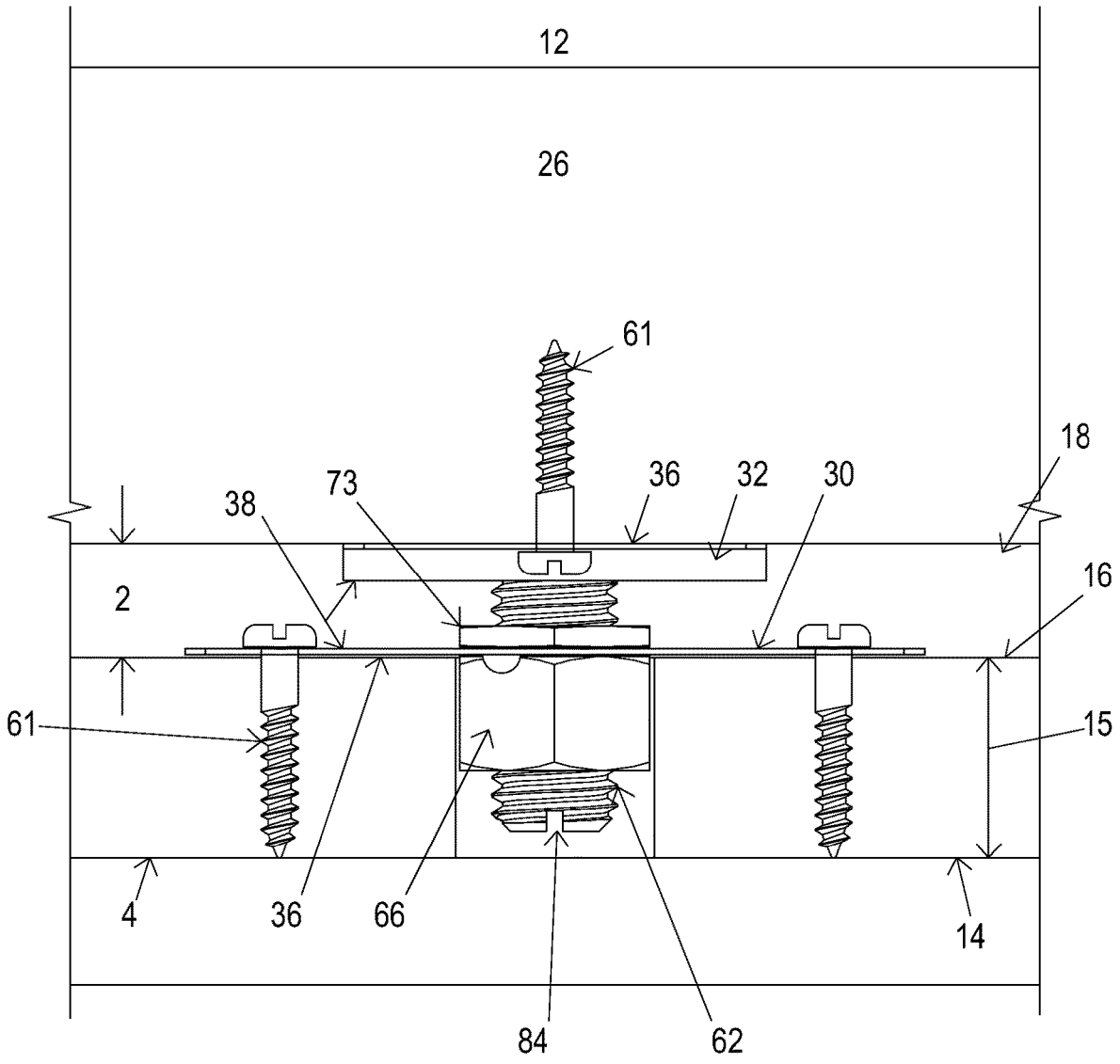
Figure 15:
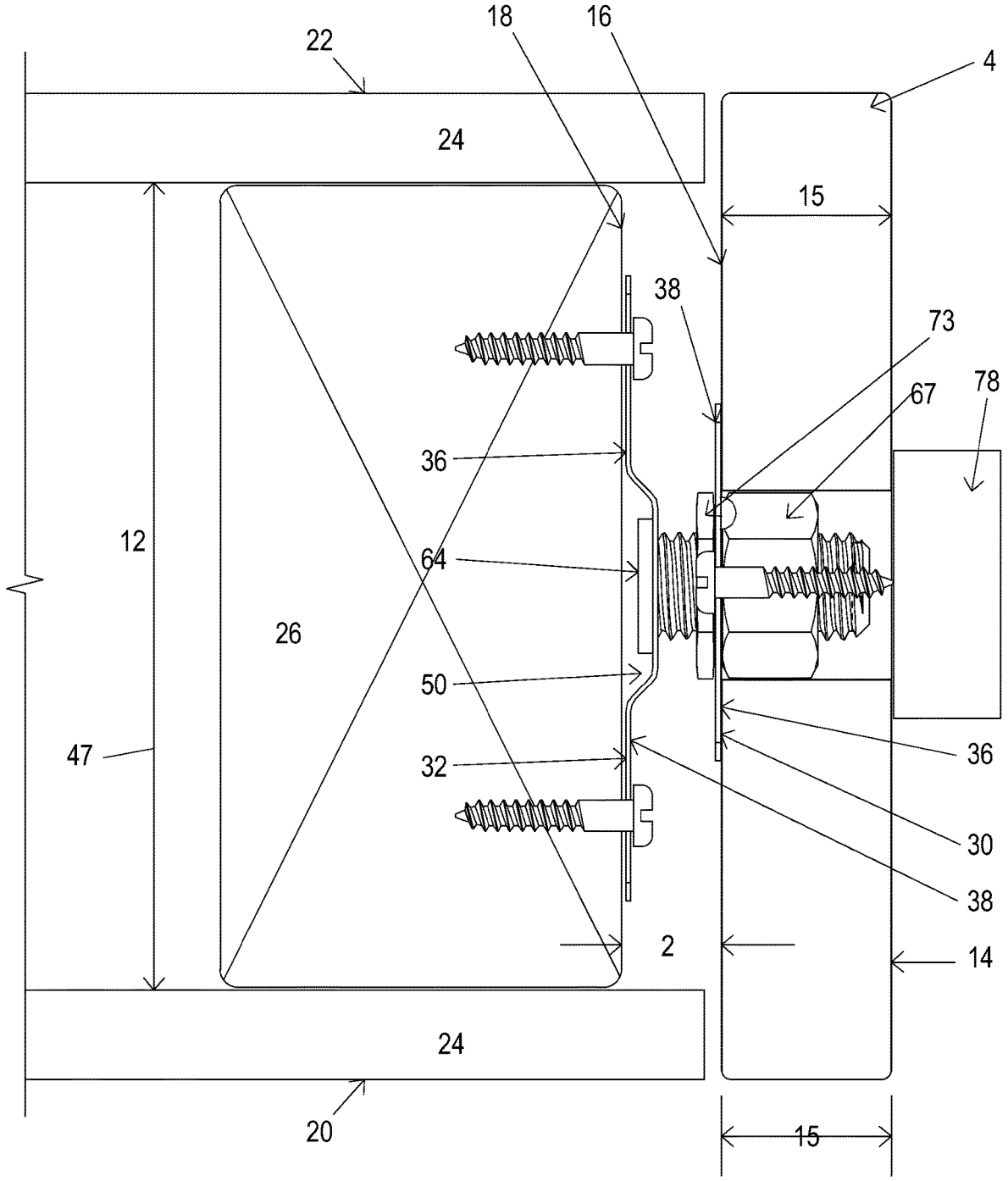
Figure 16:
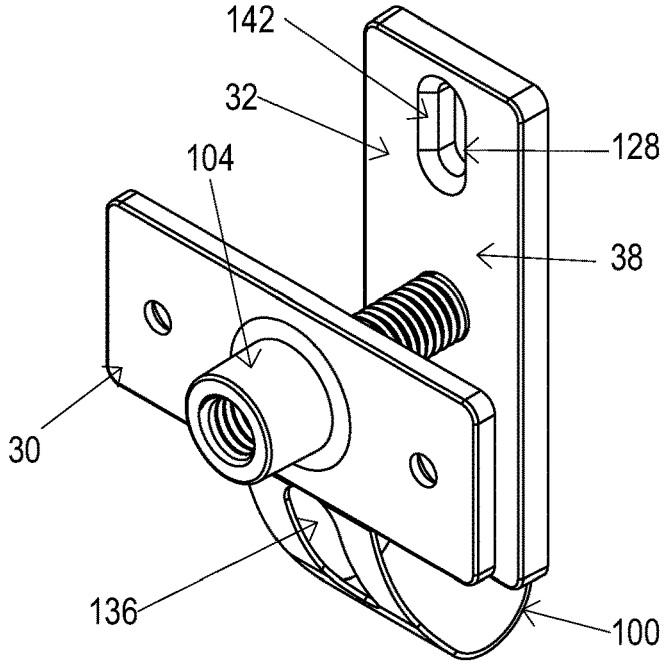
Figure 17:
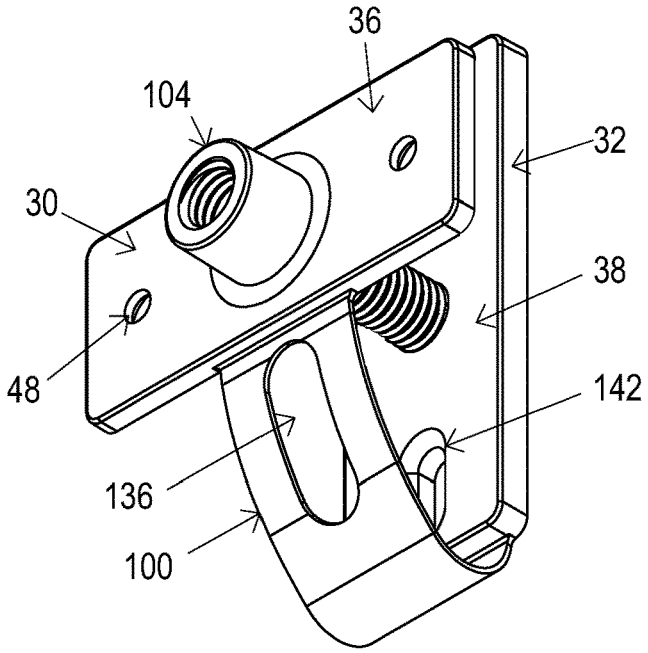
Figure 18:
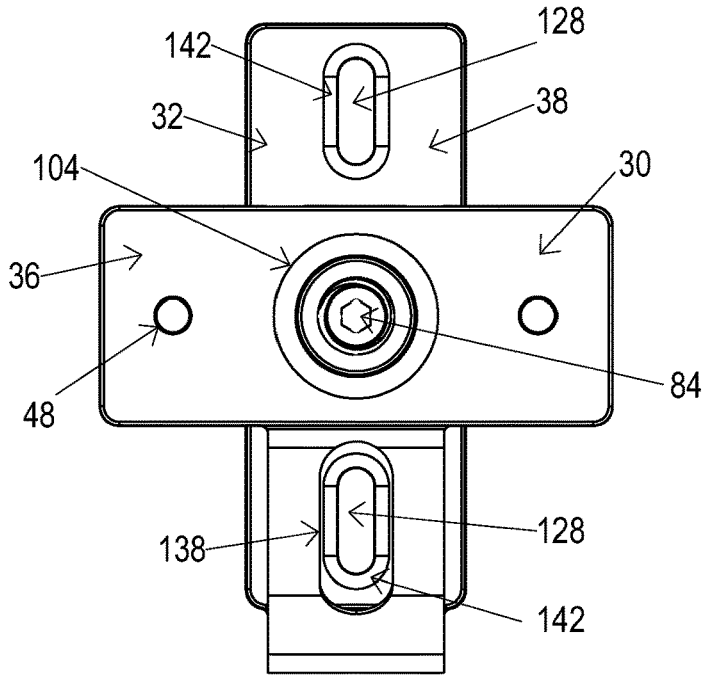
Figure 19:
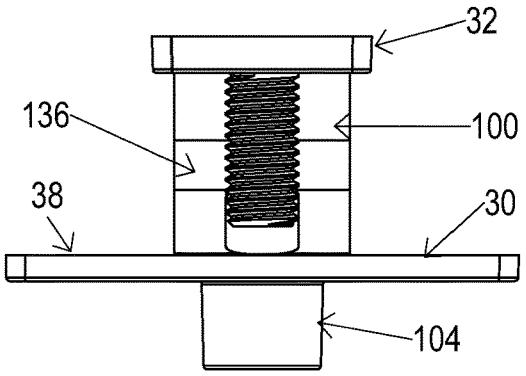
Figure 20:
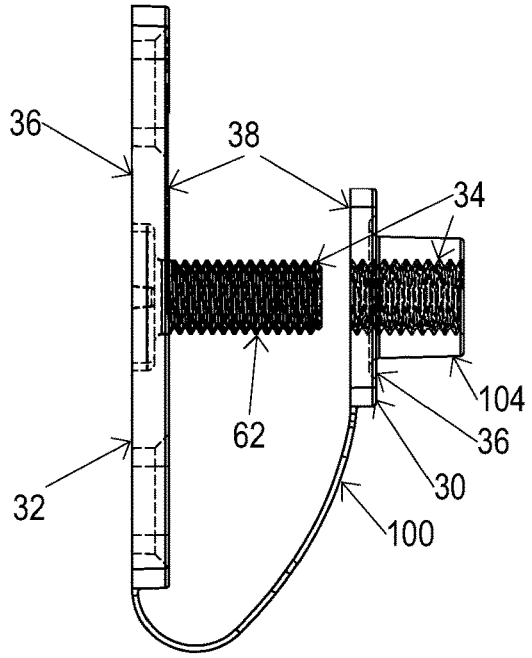
Figure 21:
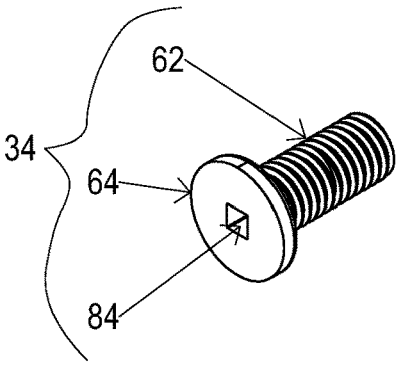
Figure 22:
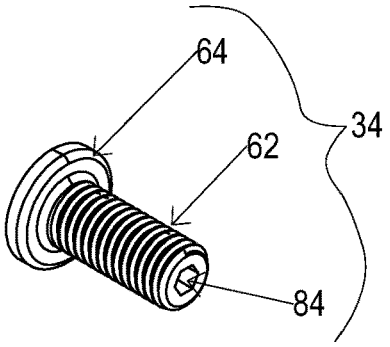
Figure 23:
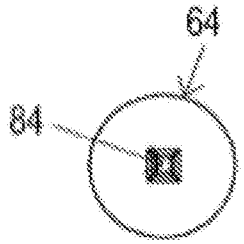
Figure 24:
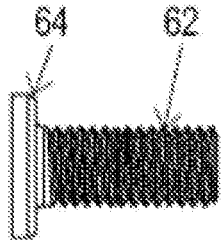
Figure 25:
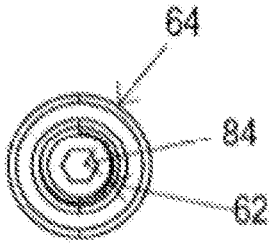
Figure 26:
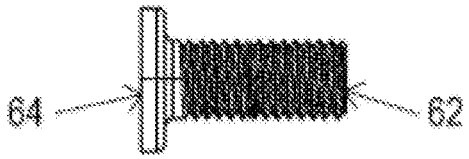
Figure 28:
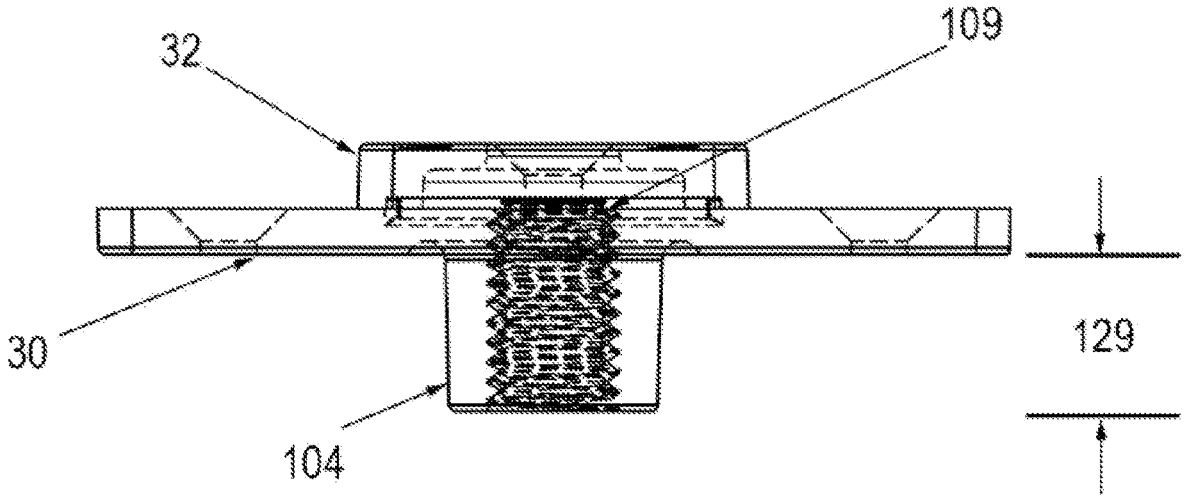
Figure 27:
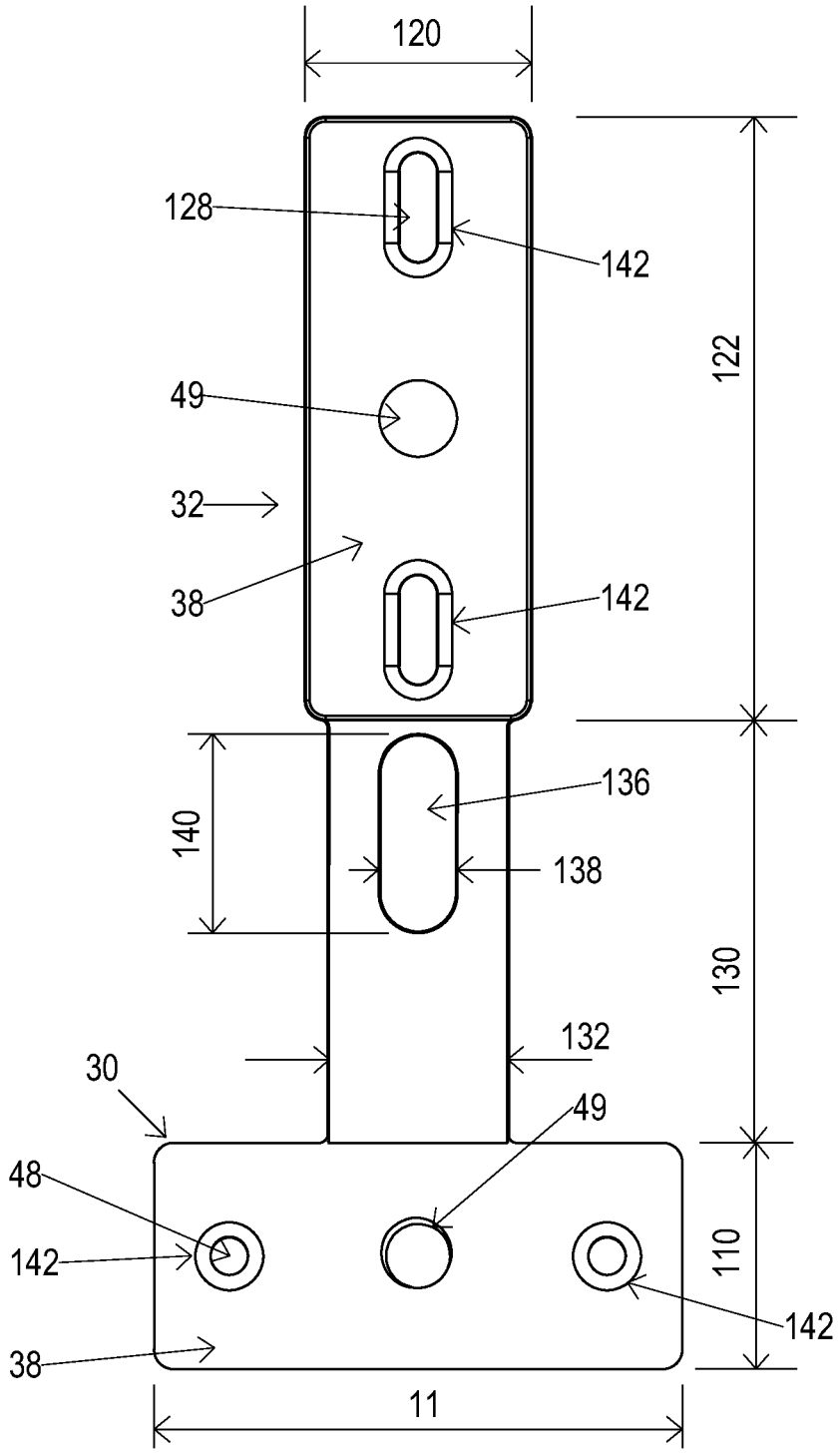
Figure 29:
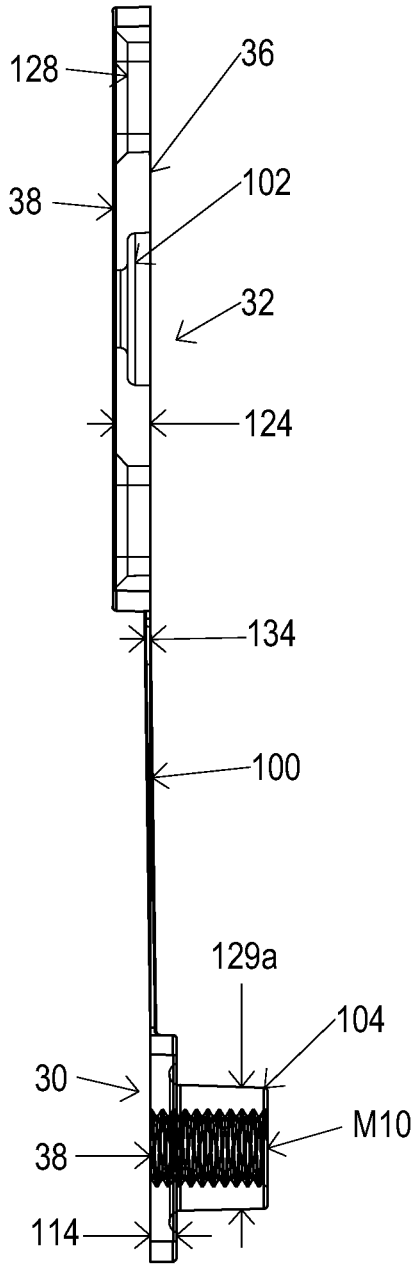

The planar member 30 being used to affix to the rear face 16 of the jamb base member 76 or base member 76 is selected to be oriented horizontally or vertically and the other planar member 32 being fixed to the end face 18 of the wall 12 is selected to be oriented vertically or horizontally as seen in the difference between FIG. 9 versus FIG. 15. This is done to allow the access apertures 80, 82 to be patterned in a substantially vertical row to allow them to be more easily covered by the door stop member 78. However, equally other versions of orientation are equally possible as long as they fit within the width of the jamb and the frame of the wall 12 (ie should not protrude beyond the wall frame thickness 47 is the governing maximum width or length the planar members 30, 32 can be), even if not using the stop member 78 to cover the access apertures 80, 82. Conceivably the planar members 30, 32 can even overlap which would mean drilling the access apertures 80, 82 after fitting the planar member 30 to the rear face 16 of the jamb member 4 or base member 76.

These access apertures 80, 82 with or without the stop member 78 can be covered by filling with suitable filler material or capping. The orientation of the access apertures 80 being at right angles to the apertures 48, 49, 128 of the front planar member 30 allows the access apertures 80 to be drilled through the jamb member 4 or jamb base member 76 without needing to go through the front or first planar member 30 when it is attached to the rear face 16 of the jamb base member 76.

The planar members 30, 32 are shown as being rectangular in shape but equally another shape is possible such as for example square, diamond or circular and also the shape of one planar member 30 or 32 need not be the same as the shape of the other planar member 32 or 30.

Other variations include having the assembly of the planar members 30, 32 having at least one strap member 100 or similarly joined or connected there between for the other assembly having the planar members 30, 32 without the strap 100. Head 64 is seated in a peripheral recess of a central part of the rear or second planar member 32 which allows adequate seating and bearing and rotation there around but able to hold the bolt 64 in place longitudinally. The length of the bolt 62 needs to be less than the combined base member thickness 15 plus the clearance gap 2 to allow easier adjustment of the bolt 62 without the need to trim to allow for the stop member 78 to be fitted to cover all of the access apertures 80, 82. Though this is not essential, as one can trim the bolt 62 later or recess a rear side of the stop member to allow for this. Fasteners 61 should be those of suitable length to affix to the base member and wall. Strap 100 can be attached to the top of the planar members 30, 32 or alternatively attached to the bottom of the planar members 30, 32.

In the methods when considering a sequence of steps for several adjustment apparatus 1 either in a row on one side or on different sides of the opening 10 in the clearance space 2, any different or variation sequence of steps for each attachment of the fasteners 61 of each of the rear or second planar member 32 of apparatus 1 (after attaching the front or first planar member 30 to rear face 16 of the jamb member 4 or base member 76) and then (or before) adjustment means 34 using 62 and 101 is envisaged whereby each apparatus 1 has upper and lower attachment 61 which can be varied in sequence with respect to each other and also varied with respect to the adjustment means 34 ie the adjusting bolts 62 and 101. The apparatus 1 of present invention is able to adjust the distance between the planar member 30, 32 especially when one of those members 32 or 30 is more stiffer or less flexible than the other planar member 30 or 32 which can include adding the backing plate 150 and/or attached to the second or rear planar member 32 to a wall 12. When using the apparatus 1 the front planar member 30 is attached to the base member 76 of the jamb member 4 which can then be or not provisionally or temporarily attached to the wall leaving a suitable clearance space 2 to allow suitable adjustment.

Figure 32:
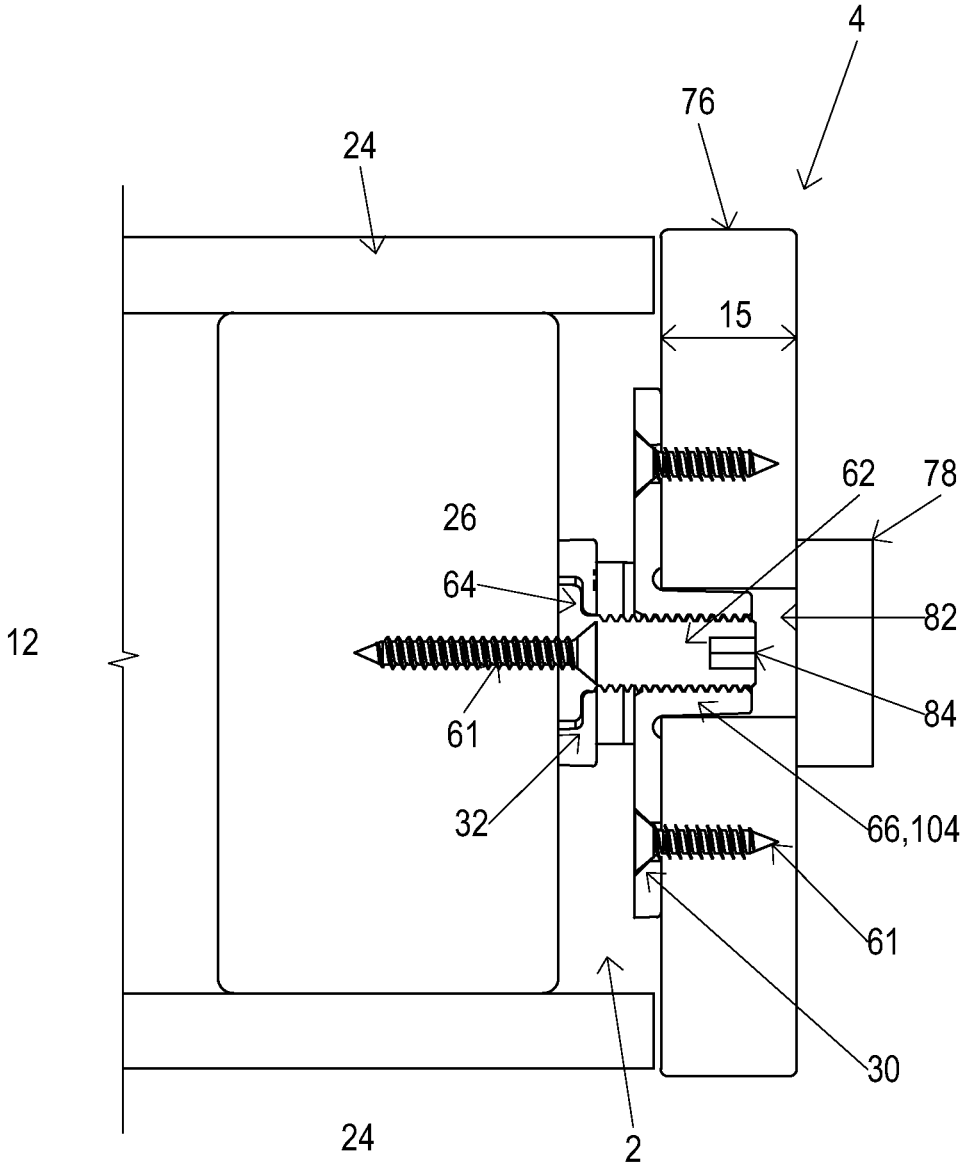

In yet other options, the adjustable packer apparatus can be sold as separate items for use with any door frame ie jamb, though in other options, the door frame combined with the adjustment packer apparatus can be attached to a rear of the side jambs, can be sold as a combination assembly. Jamb member 4 is formed or made up of a jamb base member 76 and stop member 78 which in other options if formed as an integrally formed member the access holes may simply be drilled through the stop member 78 with filler or cap to cover these holes. When mentioned the jamb member 4 being moved or adjusted, one is really meaning that the jamb base member 76 of jamb member 4 is what is at least being moved or adjusted. The thickness of the planar members 30, 32 and clearance space 2 must be enough to allow for suitable adjustment and enough overhang of the wall covering 24 whereby the base member 76 abuts the end of the wall covering leaving a recessed clearance space there between as seen in FIGS. 9, 15, 32.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

Adjustment of the apparatus can be by use of apertures 48 being slotted as shown in the apparatus of the second embodiment as in FIGS. 16-32

What I claim is:

1. An adjustable packer apparatus for adjusting a clearance space between members of the adjustable packer apparatus and when in use between at least two support members, wherein the adjustable packer apparatus comprises at least one first and one second planar member and adjustment means, wherein the first and second planar members are spaced from each other and each include a body with at least one aperture there through whereby one of the first and second planar members is adjustably movably attachable by the adjustment means through alignment of the at least one aperture of the one planar member to the other planar member and the adjustment means includes at least one bolt having a head at one end thereof, an adjusting end at another end thereof and an outer thread body movably attached to and protruding from the second planar member and the first planar member has a threaded member protruding therefrom, wherein the bolt is threadingly engaged with the threaded member, wherein the second planar member is attachable to one of the at least two support members which provides a stiffer support than that provided by or for the first planar member, whereby adjusting the adjustment means causes at least one of the first and second planar members to move in a direction perpendicular to a plane lying in the one planar member which is attachable to one of the at least two support members with respect to the other planar member which is attachable to the other support member to reduce or increase a clearance there between the first and second planar members, whereby during adjustment rotation initiated from/about the adjusting end either clockwise or anti-clockwise, of the bolt which threadingly moves and travels through the threaded member while a head end of the bolt is held positionally there about but is rotatable there about, the second planar member, an optional backing plate and a wall are immovable or not readily deformable in comparison to the first planar member and a jamb member or a base member, to cause the first planar member with the threaded member with the jamb member or the base member to move accordingly to either narrow or widen the clearance space between the first and second planar members and between the jamb member or base member and the wall or the optional backing plate, wherein the wall includes a structure having a thickness and an opening wherein the opening includes a reveal or wall frame facing the opening and a jamb base member sized and configured to face a wall frame face by having a width similar to the thickness of the wall with the wall covering and being spaced there from by the clearance space wherein the first and second planar members have an area, being a planar area oriented at right angles to the thickness and width of the first and second planar members, said area being selected to not protrude beyond the wall thickness and jamb thickness and be less than the width of the wall frame of the wall, wherein the second planar member is shaped having a central recessed portion or a central cavity portion to house the head of the bolt which allows the head of the bolt to rotate but not move from a position in the recessed portion or central cavity portion when the outer thread body is rotating during adjustment, the recessed portion or central cavity portion has a depth dimension greater than a thickness dimension of the second planar member so that the head of the bolt does not protrude beyond the second planar member and into one of the at least two support members.

2. The adjustable packer apparatus as claimed in claim 1 wherein when in use one of the first and second planar members is a first planar member attachable to a rear face of one of the at least two support members and the second planar member is attachable to the other support member wherein one of the at least two support members is stiffer or less flexible than the other support member, wherein the one support member is a jamb member or base member and the other support member is a back plate member or part of a wall which is stiffer than the first planar member and the jamb base member whereby movement by the adjustment means of a portion of the jamb member causes the clearance space to be reduced by pulling the first planar member and the jamb base member towards the wall or the clearance space is enlarged by pushing the first planar member and the jamb base member away from the wall, whereby narrowing the clearance space includes anti-clockwise turning/rotating of the bolt towards the first planar member, away from the second planar member because the second planar member, when attached to the wall is relatively immovable as compared to the jamb member or base member and the head is freely rotatable within the second planar member but not longitudinally movable, the bolt turning causes the head of the bolt to pull against screw fasteners of the second planar member while threading through a nut/sleeve of the first planar member which draws or pulls in the jamb member or base member/first planar member towards the wall or the second planar member while the bolt threadingly travels towards and through the first planar member causing an end of the bolt to protrude within an access aperture of the nut/sleeve, and expanding the clearance space includes clockwise turning/rotating of the bolt towards the second planar member/wall, away from the first planar member/jamb member or base member but because the wall is relatively immovable as compared to the jamb member or the base member, and the head is freely rotatable within the second planar member but not longitudinally movable, the bolt turning causes leveraging or pushing of the bolt head against the wall/second planar member while the bolt threadingly travels away from and through the nut/sleeve of the first planar member in an opposite direction, to push or draw the first planar member/jamb member or base member outwardly away from the second planar member/wall causing an end of the bolt to not protrude from the nut/sleeve within the access aperture.

3. The adjustable packer apparatus as claimed in claim 1 wherein the direction of adjustment is oriented in a plane parallel with a length of the adjustment means, or at right angles to respective planes of the first and second planar members whereby the threading rotational movement of the adjustment means about a fixed length position with the head, held in the second planar member at one end, and threadably within the fastening nut or sleeve as attached to the first planar member at the other end thereof, causing the first planar member and the jamb base member to be pushed in towards or pulled out of at least a portion of the first planar member and the jamb base member with respect to the other planar member and the wall with the second planar member thereby altering the clearance space there between the first and second planar members and the at least two support members and the wall.

4. The adjustable packer apparatus as claimed in claim 1 wherein the one support member is at least a part of a door or window jamb base member and the other support member is part of a wall or wall frame and the jamb base member is shaped and constructed to be movable with respect to the wall frame whereby the first planar member has apertures for fastening the first planar member to a rear face of the jamb base member, wherein the jamb member comprising when assembled or formed a body including a jamb base member and a stop member wherein the base member includes a row of access apertures which are positioned to be co-extensive or aligned with the apertures, of the second planar member to allow insertion of at least one fastener to be inserted there though apertures to apertures to fasten the second planar member to the wall and to allow access to the adjustment means from the second planar member protruding through a central access aperture to allow for adjustment of the first planar member attachable to the jamb base member with respect to the wall.

5. The adjustable packer apparatus as claimed in claim 1 wherein, the bolt of the adjustment means comprises a threaded member, and the threaded members are first and second nut fasteners, wherein one fixed nut fastener or threaded sleeve is located within and beyond the central aperture attached to the first planar member.

6. The adjustable packer apparatus as claimed in claim 1 wherein, the first and second planar members include a body with a row of fixing apertures for sliding receipt of fasteners there through wherein the apertures for each of the first and second planar members include at least outer apertures and a middle or a central aperture between the two outer apertures wherein the middle apertures are for the adjustment means to be adjustably and movably affixed thereto and the outer apertures are for providing fixing of the first and second planar members to each of the at least two support members.

7. The adjustable packer apparatus as claimed in claim 1 wherein, at least one of the first and second planar members are rectangularly shaped having a length and thickness wherein the thickness is less than the width, and the length is longer than the width, and the length of the first planar member is less than the width or thickness of the jamb base member and the width of the second planar member is less than the width or thickness of the wall.

8. The adjustable packer apparatus as claimed in claim 1 wherein, the first and second planar member is configured to be trimmed after installation to fit within the thickness of the wall without coverings or width of the jamb base member and not protrude therefrom, at least one of the apertures of the first and second planar members is provided with at least one slotted aperture to allow for adjustment of the jamb base member and the adjustable packer apparatus in a vertical plane with respect to the wall after installation of the jamb base member with attached first planar member but before attachment of the second planar member to the wall wherein the slotted apertures are provided in the apertures of the second rear planar member whereas horizontal or sideways adjustment of the jamb base member and the adjustable packer apparatus is permitted whereby one fastener is located but not attached to the second rear planar member to the wall to allow rotation of the frame member by pivoting there about before a final fastening in place of the second planar member to the face of the wall.

9. The adjustable packer apparatus as claimed in claim 1, wherein the first and second planar members are spaced from each other and adjustably fastened together by the adjustment means whereby a nut fastener or sleeve is located on one side of the front planar side or first surface of the first planar member and a nut fastener is located on the other side or second surface of the first planar member being located within aperture and access aperture and the bolt of the adjustment means has the head located on an outer or rear face or first surface of the second planar member.

10. The adjustable packer apparatus as claimed in claim 1 wherein a joining means joins or connects the first planar member to the second planar member wherein the joining means is formed of an elongate planar member being of a material and shape more flexible than the first and second planar members which functions to keep relative positions and orientation between the first and second planar members to be substantially constant during manufacture, installation and/or adjustment.

11. The adjustable packer apparatus as claimed in claim 1 wherein, a row of apertures of one of the first and second planar members are oriented at right angles to a row of apertures of the other planar member, the first and second planar members are fabricated from a metal or plastics material and abutment members is/are inserted, driven or screwed beside the length dimension of the second planar member to prevent rotation of the second planar member when the adjustment means are being inserted, fitted or adjusted into place on and with respect to the jamb and the first planar member having a longitudinal major axis is orientated at an angle with regard to a longitudinal major axis of the second planar member wherein the first planar member having a longitudinal major axis is orientated at right angles to a longitudinal major axis of the second planar member.

12. The adjustable packer apparatus as claimed in claim 1 wherein, a thickness of the first and second planar members, the depth of the clearance between the at least two support members and a length of the adjustment means are selected to allow for adjustment there between the at least two support members and the thickness of the first and second planar members cannot be thicker than the clearance space between the at least two support members.

13. The adjustable packer apparatus as claimed in claim 1 wherein, the length of the threaded member or threaded bolt needs to be longer than a combined dimensions of a clearance between the jamb base member and wall the thickness of the first and second planar members the thickness of the jamb base member, and length of a fixing nut threaded sleeve to allow for adjustment of the clearance space between the at least two support members.

14. A method of installation of an adjustable packer apparatus for adjusting a clearance space between members of the adjustable packer apparatus and when in use between at least two support members of at least one side of a wall opening having a hinged side, wherein the adjustable packer apparatus comprises at least one first and one second planar member and adjustment means, wherein the first and second planar members are spaced from each other and each include a body with at least one aperture there through whereby one of the first and second planar members is adjustably movably attachable by the adjustment means through alignment of the at least one aperture of one of the first and second planar members to the other of the first and second planar members and the adjustment means includes at least one threaded bolt member having a head at one end, adjusting end at another end and an outer thread body there between movably attached to and protruding from the second planar member and the first planar member has a threaded member protruding therefrom, wherein the bolt is threadingly engaged with the threaded member, wherein at least the second planar member is attachable to one of the at least two support members which provides a stiffer support than that provided by or for the first planar member, whereby adjusting the adjustment means causes one of the first and second planar members to move in a direction perpendicular to a plane lying in the one planar member which is attachable to one of the at least two support members with respect to the other planar member which is attachable to the other support member to reduce or increase the clearance there between the first and second planar members, whereby during adjustment rotation initiated from/about the adjusting end either clockwise or anti-clockwise, of the bolt which threadingly moves and travels through the threaded member while a head end of the bolt is held positionally there about but is rotatable there about, the second planar member, an optional backing plate and a wall are immovable or not readily deformable in comparison to the first planar member and a jamb member which includes at least a jamb base member, to cause the first planar member with the threaded member with at least the jamb base member to move accordingly to either narrow or widen the clearance space between the first and second planar members and between the jamb member or the jamb base member and the wall or the optional backing plate, wherein the wall includes a structure having a thickness and an opening wherein the opening includes a reveal or wall frame facing the opening and the jamb base member is sized and configured to face a wall frame face by having a width similar to the thickness of the wall with the wall covering and being spaced there from by the clearance space wherein the first and second planar members have an area, being a planar area oriented at right angles to the thickness and width of the first and second planar members, said area being selected to not protrude beyond the wall thickness and jamb thickness and be less than the width of the wall frame of the wall, wherein the second planar member is shaped having a central recessed portion or a central cavity portion to house the head of the bolt which allows the head of the bolt to rotate but not move from a position in the recessed portion or central cavity portion when the outer thread body is rotating during adjustment, the recessed portion or central cavity portion has a depth dimension greater than a thickness dimension of the second planar member so that the head of the bolt does not protrude beyond the second planar member and into one of the at least two support members, wherein the method includes:

assembling or providing the at least one adjustable packer apparatus including the first and second planar members and the adjustment means;

a) providing at least one of the at least two support members for positioning adjacent another support member of the at least two support members to provide when fitted to an opening in a wall a clearance space there between;

b) by locating a position of stop member, drilling vertical oriented spaced holes, an outer access hole or apertures and middle access apertures to provide co-linear access to holes/apertures of the second rear planar member when being attached to a stud of the wall frame;

c) installing the adjustable packer apparatus on a rear face of the jamb base member, by fixing fastening fasteners through horizontal oriented apertures of first planar member to back face of one of the at least two support members;

d) positioning the jamb base member to be attached with the first planar member to the rear face, into the opening of the wall to create the clearance space there between the base member and the support member of the at least two support members;

e) affixing the adjustable packer apparatus by fastening fasteners through vertically oriented access apertures of the second planar member to an end face of the other support member of the at least two support members;

f) operating the adjustable packer apparatus to adjust a size of the clearance space by initiating adjustment means via the adjusting end of the threaded elongate member through a middle aperture and through a nut fastener or a threaded sleeve to cause one of the at least two support members and one of the first and second planar members to move with respect to the other of the at least two support member and the other of the first and second planar members;

g) optionally affixing a stop member in place on a jamb base member of a jamb member to cover access apertures.

15. The method of claim 14 wherein after installation of the adjustable packer apparatus in the clearance space between the jamb base member and the wall before fixing the second planar member to the face of wall adjustment of the position of the jamb base member or the adjustable packer apparatus can be made vertically using the apertures which are slotted apertures or horizontally by locating but not fixing one fastener in the top or bottom apertures which allows at least the jamb base member to be moved or rotated horizontally about the one screw before final fastening in place of the second planar member to the face of the wall.

16. A door jamb assembly which includes at least one adjustable packer apparatus for adjustably packing a clearance space between two support members wherein the door jamb assembly includes the at least one adjustable packer apparatus which comprises at least one first and one second planar member and adjustment means, wherein the first and second planar members are spaced from each other and each include a body with at least one aperture there through whereby one of the first and second planar members is adjustably movably attachable by the adjustment means through alignment of the at least one aperture of the one planar member to the other planar member and the adjustment means includes at least one bolt having a head at one end thereof, an adjusting end at another end thereof, and an outer thread body movably attached to and protruding from the second planar member and the first planar member has a threaded member protruding therefrom, wherein the bolt is threadingly engaged with the threaded member, wherein the at least second planar member is attachable to one of the two support members which provides a stiffer or less flexible support than that provided by or for the first planar member, whereby adjusting the adjustment means causes one of the first and second planar member members to move in a direction perpendicular to a plane lying in the one planar member attachable to one of the two support members with respect to the other of the first and second planar members which is attachable to the other support member to reduce or increase a clearance there between the first and second planar members, whereby during adjustment rotation initiated from/about the adjusting end either clockwise or anti-clockwise, of the bolt which threadingly moves and travels through the threaded member while a head end of the bolt is held positionally there about but is rotatable there about, the second planar member, an optional backing plate and a wall are immovable or not readily deformable in comparison to the first t planar member and jamb member or base member, to cause the first planar member with the threaded member with the jamb member or base member to move accordingly to either narrow or widen the clearance space between the first and second planar members and between the jamb member or base member and the wall or the optional backing plate, wherein the wall includes a structure having a thickness and an opening wherein the opening includes a reveal or wall frame facing the opening and the jamb base member is sized and configured to face a wall frame face by having a width similar to the thickness of the wall with the wall covering and be spaced there from by the clearance space wherein the first and second planar members have an area being a planar area oriented at right angles to the thickness and width of the first and second planar members, said area being selected to not protrude beyond the wall thickness and jamb thickness and be less than the width of the wall frame of the wall.

* * * * *